US006569613B1

(12) United States Patent
Oya et al.

(10) Patent No.: US 6,569,613 B1
(45) Date of Patent: May 27, 2003

(54) SILVER HALIDE PHOTOGRAPHIC EMULSION

(75) Inventors: Toyohisa Oya, Kanagawa (JP); Hiroyuki Suzuki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/075,600

(22) Filed: Feb. 15, 2002

(30) Foreign Application Priority Data

Feb. 19, 2001 (JP) ..... 2001-041830
Feb. 23, 2001 (JP) ..... 2001-048658

(51) Int. Cl.[7] ..... G03C 1/09
(52) U.S. Cl. ..... 430/600; 430/601; 430/603; 430/605
(58) Field of Search ..... 430/605, 601, 430/603, 600, 608

(56) References Cited

U.S. PATENT DOCUMENTS 5,049,484 A 9/1991 Deaton
5,049,485 A 9/1991 Deaton

FOREIGN PATENT DOCUMENTS

JP 8-69075 3/1996

*Primary Examiner*—Richard L. Schilling
(74) *Attorney, Agent, or Firm*—Sughrue Mion, PLLC

(57) ABSTRACT

A silver halide emulsion comprising at least one gold-containing compound represented by composition formula (1):

$$[Au(0)Lm]Xn \quad (1)$$

wherein Au(0) is an Au atom having a valence of zero, L is a compound having at least one group capable of being adsorbed to or coordinating with Au(0), m is a value of 0 or more including decimals, X is an ion required for neutralizing electric charge of the compound, and n is a value of 0 or more including decimals.

18 Claims, No Drawings

SILVER HALIDE PHOTOGRAPHIC EMULSION

FIELD OF THE INVENTION

The present invention relates to a silver halide photographic (light-sensitive) material and a silver halide photographic emulsion for the photographic material. In particular, the present invention is concerned with a silver halide photographic material which undergoes sensitization with a hydrophilic compound containing gold with a valence of zero (which is expressed as Au(0) hereinafter) and thereby achieves high sensitivity and slight fogging.

BACKGROUND OF THE INVENTION

In order to obtain the desired sensitivity and gradation, silver halide emulsions used in silver halide photographic (light-sensitive) materials are generally subjected to chemical sensitization using various chemical substances. As representative methods for chemical sensitization, there are known a wide variety of methods including a sulfur sensitization method, a selenium sensitization method, a tellurium sensitization method, a noble metal sensitization method such as a gold sensitization method, a reduction sensitization method and various combinations of these methods. For silver halide photographic (light-sensitive) materials, high sensitivity, excellent graininess, high sharpness and rapid processing in which rate of development is increased, have recently grown in demand, and therefore various improvements to the sensitization methods have been made. Of those improved methods, most prevailingly employed methods are gold-sulfur sensitization methods using combinations of gold compounds and "labile sulfur compounds" capable of producing silver sulfide by reaction with silver ion. And they are described specifically in P. Grafkides, *Chimie et Physique Photographique*, 5th Ed., Paul Montel (1987), T. H. James (editor), *The Theory of the Photographic Process*, 4th Ed., Macmillan (1977), and H. Frieser, *Die Grundlagen der Photographischen Prozesse mit Silber-halogeniden*, Akademische Verlagasgeselshaft (1968).

In subjecting a silver halide emulsion to gold-sulfur sensitization, it is a general manner that a gold compound and an labile sulfur compound capable of producing silver sulfide by reaction with silver ion are added individually. Such a manner is described in the references described above, *Nippon Shashin Gakkai-shi* (Journal of the Japanese Photographic Society), Vol. 50, No. 2, from p. 108 onward (1987), and *Journal of the Optical Society of America*, Vol. 39, No. 6, from p. 494 onward.

Hitherto, the gold-sulfur sensitization has been carried out using chloroauric acid as the gold compound and a thiourea compound or a thiosulfate as the labile sulfur compound. However, the use of these compounds has various problems. For instance, it cannot increase the sensitivity to a satisfactory extent, tends to cause fogging, lowers the contrast, and becomes a cause of serious fogging upon long-term storage of photosensitive materials. Therefore, solutions to these problems have been urgently required.

On the other hand, methods of using gold compounds other than chloroauric acid in the gold-sulfur sensitization have been known. Such gold compounds include the gold complexes of thioethers as disclosed in Japanese Patent Application (Laid-Open) Nos. 6447/1963 and 85239/1987, the gold complexes of rhodanines as disclosed in Japanese Patent Application (Laid-Open) No. 147537/1989, the gold complexes of meso ions as disclosed in Japanese Patent Application (Laid-Open) No. 267249/1993, and the gold complexes of hydantoins as disclosed in Japanese Patent Application (Laid-Open) No. 268550/1993. However, all of these complexes are insufficient for resolution of those problems.

In addition, Japanese Patent Application (Laid-Open) Nos. 67032/1993, 75053/1993 and 86649/1993 disclose the gold complex compounds which are reported therein to have improving effects on an increase of fog and graininess deterioration accompanied by the fog increase during long-term storage of light-sensitive materials. Further, Japanese Patent Application (Laid-Open) No. 266826/1992 discloses the cases of using gold complexes wherein a trivalent gold ion is coordinated with tetrasubstituted thiourea molecules.

However, all of these compounds also are insufficient for resolution of the above problems.

Further, in Japanese Patent application (Laid-Open) No. 204724/1993, a method in which a gold compound and an labile selenium compound capable of producing the silver selenide by reaction with silver ion are added individually. However, in this case, the fog is extremely generated, and therefore the resolution of the above problems can not be achieved.

Also, in Langmuir, page 1075 (1999), gold fine particles in which a compound containing a mercapto group as an adsorbing group for a gold atom and a carboxyl group as a hydroxyl group is adsorbed as a stabilizer, is described. However, the effect due to a sensitizer of the gold fine particle has not been conventionally known.

SUMMARY OF THE INVENTION

The present invention is made for achieving a breakthrough in those circumstances. An objective of the present invention is therefore to provide a silver halide photographic (light-sensitive) material and a silver halide photographic emulsion for the photographic material, which undergoes gold sensitization with a compound containing gold with a valence of zero and achieves an increase in sensitivity and a reduction in fogging.

The objective is attained by the following embodiments of the present invention:

1. A silver halide emulsion, containing at least one gold-containing compound represented by composition formula (1):

$$[Au(0)Lm]Xn \quad (1)$$

wherein Au(0) is an Au atom having a valence of zero, L is a compound having at least one group capable of being adsorbed to or coordinating with Au(0), mis a value of 0 or more including decimals, X is an ion required for neutralizing electric charge of the compound, and n is a value of 0 or more including decimals.

2. A silver halide emulsion, being chemically sensitized with a gold-containing compound represented by the foregoing composition formula (1).

3. The silver halide emulsion according to the above item 2, wherein the L in composition formula (1) is a compound having a group containing at least one atom selected from the group consisting of a sulfur atom, a selenium atom, a tellurium atom, a nitrogen atom and a phosphorus atom.

4. The silver halide emulsion according to the above item 2, wherein the compound represented by L in composition formula (1) has at least one hydrophilic group.

5. The silver halide emulsion according to the above item 4, wherein the hydrophilic group is a carboxyl group, a sulfo group or an ammonium salt.

6. The silver halide emulsion according to the above item 2, wherein the group capable of being adsorbed to or coordinating with Au(0) is a mercapto group, an alkylthio group, an arylthio group or a thiocarbonyl group.

7. The silver halide emulsion according to the above item 2, wherein the L in composition formula (1) is a compound having at least one mercapto group and at least one carboxyl group.

8. The silver halide emulsion according to the above item 2, wherein the L in composition formula (1) is thiomalic acid.

9. The silver halide emulsion according to the above item 2, wherein the L in composition formula (1) is at least one compound selected from the group consisting of a thioether compound, a selenoether compound, a telluroether compound, a thioamide compound, a selenoamide compound, a telluroamide compound, an amino group-containing compound, a phosphino group-containing compound and a nitrogen-containing heterocyclic compound.

10. The silver halide emulsion according to the above item 2, wherein the compound of composition formula (1) is in a state of a super fine grain having an average size of not greater than 10 nm.

11. The silver halide emulsion according to the above item 2, comprising silver halide grains in which at least 60% of an entire projected area of the silver halide grains are occupied by a tabular silver halide grain having an aspect ratio of at least 8.

12. The silver halide emulsion according to the above item 2, wherein the silverhalide emulsion is internal latent image type direct-positive silver halide emulsion which comprises silver halide grains having a core/shell structure made up of a chemically sensitized core and a chemically sensitized shell.

13. A method of chemically sensitizing a silver halide emulsion, using a compound of the foregoing composition formula (1).

14. The method of chemically sensitizing a silver halide emulsion according to the above item 13, wherein the silver halide emulsion comprises internal latent image type direct-positive silver halide grains having a core/shell structure made up of a chemically sensitized core and a chemically sensitized shell and at least one of the core and the shell is chemically sensitized in the presence of super fine grains of at least one gold-containing compound of composition formula (1).

15. A silver halide photographic material comprising a support having thereon at least one silver halide emulsion layer, wherein the silver halide emulsion layer comprises at least one of silver halide emulsions according to the above item 1 or 2.

16. The silver halide emulsion according to any one of the above items 1 to 15, wherein the gold-containing compound represented by composition formula (1) is a compound represented by composition formula (2):

$$Au(0)L^1m \quad (2)$$

wherein $L^1$ represents a compound coordinating with Au(0) via a group other than a mercapto group, and m has the same meaning as in composition formula (1).

17. The silver halide emulsion according to the above item 16, wherein the $L^1$ in composition formula (2) is a compound coordinating with Au(0) via one of sulfur, selenium and tellurium atoms.

18. The silver halide emulsion according to the above item 16, wherein the $L^1$ in composition formula (2) is a compound coordinating with Au(0) via a nitrogen atom or a phosphorus atom.

DETAILED DESCRIPTION OF THE INVENTION

The gold compound of composition formula (1) (hereafter called formula (1)) of the present invention is described below in detail.

In formula (1), L represents a compound having at least one group capable of being adsorbed to or coordinating with Au(0), and m represents a number of from 0 to 1,000 including decimals. Au(0) represents an Au atom having a valence of zero. It is preferable for the compound of formula (1) to have the form of super fine grain. The suitable average grain size of the compound of formula (1) according to the present invention is 500 nm or below, preferably 100 nm or below, particularly preferably 10 nm or below, in terms of equivalent sphere diameter.

Groups capable of being adsorbed to or coordinating with Au(0) are groups containing so-called chalcogen elements, such as sulfur, selenium and tellurium atoms. Of these groups, groups containing sulfur atoms are preferred, and examples thereof include a thiocarboxyl group, a dithiocarboxyl group, a thiocyanato group, an isothiocyanato group, a thioformyl group, a thiocarbonyl group, a mercapto group, an alkylthio group and an arylthio group. Of these sulfur-containing groups, mercapto, alkylthio, arylthio and thiocarbonyl groups are more preferable. And the group advantageous in particular is a mercapto group.

It is preferable for the L in formula (1) to further have a hydrophilic group. The hydrophilic group and the group capable of being adsorbed to or coordinating with Au(0) are bound together or combined via a linking group. Examples of the hydrophilic group include a carboxyl group, a thiocarboxyl group, a sulfo group, a sulfino group, a sulfeno group, a phosphoric acid group, a boric acid group, a cyano group, a hydroxyl group and an ammonium salt. Of these groups, a carboxyl group, a sulfo group and an ammonium salt are preferable. In particular, a carboxyl group is preferable.

m represents a number of from 0 to 1,000, desirably from 0 to 100, more desirably from 0 to 10, especially desirably from 0 to 1.

X in formula (1) represents an ion if any counter ion is required for neutralizing the electric charge of the compound. When the counter ion represented by X is an anion, examples thereof include halide ions (e.g., $F^-$, $Cl^-$, $Br^-$, $I^-$), tetrafluoroborate ion ($BF_4^-$), hexafluorophosphinate ion ($PF_6^-$), sulfate ion ($SO_4^{2-}$) arylsulfonate ions (e.g., p-toluenesulfonate ion, naphthalene-2,5-disulfonate ion), and carboxy ions (e. g., acetate ion, trifluoroacetate ion, oxalate ion, bezonate ion). When the counter ion represented by X is a cation, examples thereof include alkali metal ions (e.g., lithium ion, sodium ion, potassium ion), alkaline earth metal ions (e.g., magnesium ion, calcium ion), unsubstituted or substituted ammonium ions (e.g., ammonium ion, triethylammonium ion, tetramethyl-ammonium ion), and unsubstituted or substituted pyridinium ions (e.g., pyridinium ion, 4-phenylpyridinium ion).

n is a number of X required for neutralizing the electric charge of the complex, and represents a value of from 0 to 1,000, including decimals. The suitable value of n is from 0 to 100, preferably from 0 to 10, particularly preferably from 0 to 1.

The suitable L includes a combination of a mercapto group as an adsorptive group with a carboxyl group, a sulfo group or an ammonium salt as a hydrophilic group, preferably a combination of a mercapto group as an adsorptive group with a carboxyl group as a hydrophilic group. Examples of a group connecting the adsorptive group to the hydrophilic group in L include unsubstituted or substituted linear or branched alkylene groups having 1–20 carbon atoms (e.g., methylene, ethylene, trimethylene, isopropylene, tetramethylene, pentamethylene, 3-oxapentylene, 2-hydroxytrimethylene), unsubstituted or substituted cycloalkylene groups having 3–18 carbon atoms (e.g., cyclopropylene, cyclopentylene, cyclohexylene), unsubstituted or substituted alkenylene groups having 2–20 carbon atoms (e.g., ethenylene, 2-butenylene), alkynylene groups having 2–10 carbon atoms (e.g., ethynylene), unsubstituted or substituted phenylene groups having 6–20 carbon atoms (e.g., unsubstituted p-phenylene), unsubstituted or substituted naphthylene groups having 10–20C carbon atoms (e.g., unsubstituted 2,5-naphthylene), heterocyclic linking groups (e.g., pyridylene, tetrazolyl, triazolyl, thienyl, thiadiazolyl), a carbonyl group, a sulfonyl group, a thiocarbonyl group, an ether group, an ester group, amido group, an amino group, an ureido group and a thioureido group. These groups each may further have a substituent, and any two of them may combine with each other to newly form a divalent linking group. Examples of such a substituent include halogen atoms, alkyl groups (including cycloalkyl groups and bicycloalkyl groups), alkenyl groups (including cycloalkenyl groups and bicycloalkenyl groups), alkynyl groups, aryl groups, heterocyclic groups, a cyano group, a hydroxyl group, a nitro group, a carboxyl group, alkoxy groups, aryloxy groups, silyloxy groups, heterocyclyloxy groups, acyloxy groups, carbamoyloxy groups, alkoxycarbonyloxy groups, aryloxycarbonyloxy groups, amino groups (including anilino group), acylamino groups, aminocarbonylamino groups, alkoxycarbonylamino groups, aryloxycarbonylamino groups, sulfamoylamino groups, alkyl- and arylsulfonylamino groups, a mercapto group, alkylthio groups, arylthio groups, heterocyclylthio groups, a sulfamoyl group, a sulfo group, alkyl- and arylsulfinyl groups, alkyl- and arylsulfonyl groups, acyl groups, aryloxycarbonyl groups, alkoxycarbonyl groups, carbamoyl groups, aryl- and heterocyclylazo groups, imido groups, phosphino groups, phosphinyl groups, phosphinyloxy groups, phosphinylamino groups, and silyl groups. Of these groups, alkylene groups, phenylene groups and heterocyclic linking groups are preferred as the linking group in L.

Examples of a gold-containing compound represented by formula (1) are illustrated below, but the present invention should not be construed as being limited to these examples.

| | L | m | X | n |
|---|---|---|---|---|
| 1-1 | $HSCH(CH_2CO_2H)CO_2H$ | 0.31 | $Na^+$ | 0.62 |
| 1-2 | $HSCH(CH_2CO_2H)CO_2H$ | 0.42 | $K^+$ | 0.84 |
| 1-3 | $HS(CH_2)_2CO_2H$ | 0.48 | $Na^+$ | 0.48 |
| 1-4 | $HS(CH_2)_3CO_2H$ | 0.21 | $Na^+$ | 0.21 |
| 1-5 | $HSCH_2CO_2H$ | 0.35 | $Na^+$ | 0.33 |
| 1-6 | 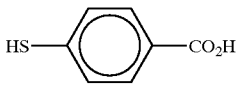 | 0.22 | $K^+$ | 0.22 |

-continued

| | L | m | X | n |
|---|---|---|---|---|
| 1-7 | 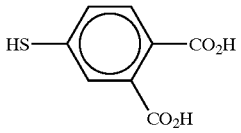 | 0.29 | $Na^+$ | 0.58 |
| 1-8 | $HS(CH_2)_2CH(CH_2CO_2H)CO_2H$ | 0.30 | $Li^+$ | 0.60 |
| 1-9 | $CH_3SCH(CH_2CO_2H)CO_2H$ | 0.12 | $Na^+$ | 0.24 |
| 1-10 | 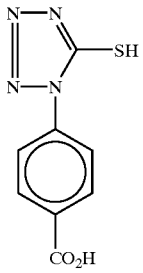 | 0.25 | $Na^+$ | 0.24 |
| 1-11 | 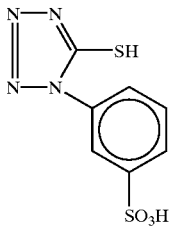 | 0.30 | $Na^+$ | 0.30 |
| 1-12 | 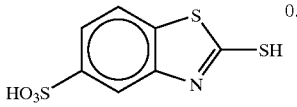 | 0.51 | $Na^+$ | 0.50 |
| 1-13 | $(HOCH_2CH_2SCH_2)_2$ | 0.15 | — | — |
| 1-14 | 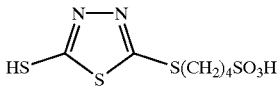 | 0.27 | $Na^+$ | 0.54 |
| 1-15 | 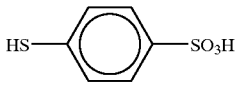 | 0.14 | $K^+$ | 0.13 |
| 1-16 | $HS(CH_2)_{12}SO_3H$ | 0.72 | $Na^+$ | 0.72 |
| 1-17 | 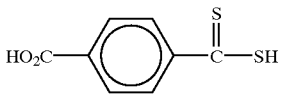 | 0.51 | $Na^+$ | 0.50 |
| 1-18 | $HO_2C(CH_2)_{14}SO_3H$ | 0.77 | $Na^+$ | 0.75 |
| 1-19 | 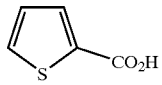 | 0.21 | $K^+$ | 0.21 |

-continued

| | L | m | X | n |
|---|---|---|---|---|
| 1-20 | $HS-(CH_2)_4-\overset{+}{N}(CH_3)_3$ | 0.30 | $Cl^-$ | 0.30 |
| 1-21 | 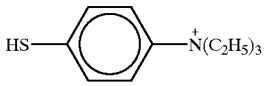 | 0.34 | $PF_6^-$ | 0.34 |
| 1-22 | 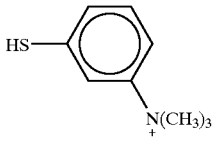 | 0.27 | $Cl^-$ | 0.27 |
| 1-23 | $HS-(CH_2)_{10}-\overset{+}{N}(CH_3)_3$ | 0.41 | $Cl^-$ | 0.41 |
| 1-24 | $HSCH(CH_2CO_2H)CO_2H$ | 0.10 | $Na^+$ | 0.20 |
| 1-25 | $HSCH(CH_2CO_2H)CO_2H$ | 1.07 | $Na^+$ | 2.14 |
| 1-26 | 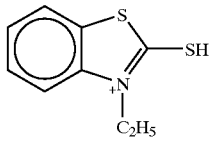 | 0.21 | $Cl^+$ | 0.21 |
| 1-27 | 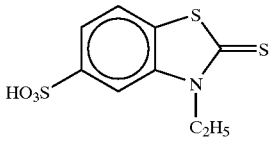 | 0.22 | $Na^+$ | 0.22 |
| 1-28 | $(HOCH_2CH(OH)CH_2SCH_2)_2$ | 0.33 | — | — |
| 1-29 | $HO(CH_2)_2O(CH_2)_2SH$ | 0.11 | — | — |

Gold-containing compounds represented by the formula (1) of the present invention can be synthesized by reference to known methods, e.g., those described in *Langmuir*, vol. 15, p. 1075 (1999), *J. Chem. Soc., Chem. Commun.*, 801 (1995), and *Chem. Lett.*, 619 (1997).

A synthesis example of a compound represented by formula (1) is shown below.

Synthesis of Super Fine Grain of Hydrophilic Gold-containing Compound (1-1):

In 100 ml of methanol was dissolved 188 mg of 2-mercaptomalic acid. This solution was added to 206 mg of chloroauric acid previously dissolved in 2 ml of water. Thereto, a 0.2 M aqueous solution of sodium borohydride was added dropwise at 25° C. with vigorously stirring over a 10-minute period. The stirring was further continued for 30 minutes at 25° C. A brown precipitates thus formed was centrifuged, and the liquid phase was removed by decantation. The precipitate was dispersed into methanol containing 20% of water, and then centrifuged. This dispersion-and-centrifugation operation was repeated 3 times. The precipitate thus obtained was dried under reduced pressure condition while keeping it at a temperature of not higher than 30° C. By ICP analysis, the gold content and the sodium content in the product were found to be 57.1% and 4.1%, respectively. Further, the water content in the product was found to be 4.9% by Tg/DTA analysis. The average grain size of the product, gold-containing Compound (1-1), was determined by observations under an electron microscope, and it was found to be 1.2 nm.

Preferred embodiments of the gold-containing compounds represented by formula (1), other than the compounds described above, are compounds represented by composition formula (2)

$$Au(0)L^1m \quad (2)$$

wherein $L^1$ represents a compound coordinating with Au(0) via a group other than a mercapto group, and m has the same meaning as in formula (1).

Examples of a compound represented by $L^1$ in composition formula (2) (hereafter called formula (2)), which has a group capable of coordinating with Au(0) other than a mercapto group, include compounds having a thioether group, a selenoether group, a telluroether group, a disulfido group, a diselenido group, a ditellurido group, a thioamido group, a selenoamido group, a telluroamido group, an amino group, a phosphino group and a 5- or 6-membered heterocyclic group, respectively, which each can coordinate with Au(0) via a sulfur (excepting the sulfur in mercapto group), selenium, tellurium, nitrogen or phosphorus atom in their individual molecules.

The thioether group-containing compound represented by $L^1$ in formula (2) is a thioether compound wherein alkyl, aryl or/and heterocyclic groups are bound to the sulfur atom. Substitution of these groups may be symmetrical or asymmetical about the sulfur atom. Examples of such a compound include dialkyl thioethers, diaryl thioethers, diheterocyclic thioethers, alkyl-aryl thioethers, alkyl-heterocyclic thioethers and aryl-heterocyclic thioethers.

The alkyl group or groups of a thioether compound represented by $L^1$ in formula (2) are substituted or substituted linear, branched or cyclic alkyl groups having 1–30 carbon atoms, preferably alkyl groups having 1–20 carbon atoms.

The aryl group or groups of a thioether compound represented by $L^1$ in formula (2) are unsubstituted or substituted monocyclic or condensed-ring aryl groups having 6–30 carbon atoms, including phenyl and naphthyl groups. Preferably, they are unsubstituted or substituted phenyl groups.

The heterocyclic group or groups of a thiother compound represented by $L^1$ in formula (2) are 5- to 7-membered, unsubstituted or substituted, saturated or unsaturated heterocyclic groups containing at least one of nitrogen, oxygen and sulfur atoms. These heterocyclic groups may be monocyclic ones or may form condensed rings together with aryl or heterocyclic rings. Those preferred as the heterocyclic groups are 5- to 6-membered ones, with examples including pyrrolyl, pyrrolidinyl, pyridyl, piperidyl, piperazinyl, imidazolyl, pyrazolyl, pyrazinyl, pyrimidinyl, triazinyl, quinolyl, isoquinonyl, indolyl, indazolyl, benzimidazolyl, pyranyl, chromenyl, thienyl, oxazolyl, thiazolyl, benzoxazolyl, benzothiazolyl, morpholino and morphornyl groups.

The thioether compounds preferred in the present invention are symmetric or asymmetric dialkyl thioethers, diaryl thioethers and alkyl-aryl thioethers.

The alkyl, aryl or/and heterocyclic groups in the thioether compound as $L^1$ have may be substituted. Examples of the substituent include halogen atoms, alkyl groups (including cycloalkyl and bicycloalkyl groups), alkenyl groups (including cycloalkenyl and bicycloalkenyl groups), alkynyl groups, aryl groups, heterocyclic groups, a cyano group, a hydroxyl group, a nitro group, a carboxyl group, alkoxy groups, aryloxy groups, silyloxy groups, heterocyclyloxy groups, acyloxy groups, carbamoyloxy groups, alkoxycarbonyloxy groups, aryloxycarbonyloxy groups, amino groups (including anilino groups), acylamino groups, aminocarbonylamino groups, alkoxycarbonylamino groups, aryloxycarbonylamino groups, sulfamoylamino groups, alkyl- and aryl-sulfonylamino groups, alkylthio groups, arylthio groups, heterocyclylthio groups, a sulfamoyl group, a sulfo group, alkyl-and aryl-sulfinyl groups, alkyl- and aryl-sulfonyl groups, acyl groups, aryloxycarbonyl groups, alkoxycarbonyl groups, carbamoyl groups, aryl- and heterocyclylazo groups, and imido groups, phosphino groups, phosphinyl groups, phosphinyloxy groups, phosphinylamino groups and silyl groups.

More specifically, the halogen atoms are, e.g.,chlorine, bromine and iodine atoms. The alkyl groups include linear, branched and cyclic unsubstituted or substituted alkyl groups. Suitable examples of linear and branched alkyl groups include alkyl groups having 1–30 carbon atoms, such as methyl, ethyl, n-propyl, isopropyl, t-butyl, n-octyl, eicosyl, 2-chloroethyl, 2-cyanoethyl and 2-ethylhexyl groups. Suitable examples of the cyclic alkyl groups include unsubstituted or substituted cycloalkyl groups having 3–30 carbon atoms, such as cyclohexyl, cyclopentyl and 4-n-dodecylcyclohexyl groups. Suitable examples of the bicycloalkyl groups included unsubstituted or substituted bicycloalkyl groups having 5–30 carbon atoms, namely monovalent groups formed by removing one hydrogen atom from individual bicycloalkanes with 5 to 30 carbon atoms, such as bicyclo[1,2,2]heptane-2-yl and bicyclo[2,2,2]octane-3-yl groups. In addition, cyclic alkyl groups may include those greater in number of rings, such as tricycloalkyl groups. The alkyl groups in the substituents described below (e.g., the alkyl moieties in alkylthio groups) are alkyl groups having the same concept as described above. The alkenyl groups include linear, branched and cyclic unsubstituted or substituted alkenyl groups. Suitable examples of such alkenyl groups, include unsubstituted or substituted alkenyl groups having 2–30 carbon atoms, such as vinyl, allyl, prenyl, geranyl and oleyl groups, unsubstituted or substituted cycloalkenyl groups having 3–30 carbon atoms, namely monovalent groups formed by removing one hydrogen atom from individual cycloalkenes having 3–30 carbon atoms, such as 2-cyclopentene-1-yl and 2-cyclohexene-1-yl groups, unsubstituted or substituted bicycloalkenyl groups having 5–30 carbon atoms, namely monovalent groups formed by removing one hydrogen atom from individual bicycloalkenes having one double bond per molecule, such as bicyclo[2,2,1]hepto-2-ene-1-yl and bicyclo[2,2,2]octo-2-ene-4-yl groups. Suitable examples of the alkynyl groups include unsubstituted or substituted alkynyl groups having 2–30 carbon atoms, such as ethynyl, propargyl and trimethylsilylethynyl groups. Suitable examples of the aryl groups include unsubstituted or substituted aryl groups having 6–30 carbon atoms, such as phenyl, p-tolyl, naphthyl, m-chlorophenyl and o-hexadecanoylaminophenyl groups. Suitable examples of the heterocyclic groups include monovalent groups formed by removing one hydrogen atom from individual 5- or 6-membered, substituted or unsubstituted, aromatic or non-aromatic heterocyclic compounds, preferably 5- or 6-membered aromatic heterocyclic groups having 3–30 carbon atoms, such as 2-furyl, 2-thienyl, 2-pyrimidyl and 2-benzothiazolyl groups. Suitable examples of the alkoxy groups include unsubstituted or substituted alkoxy groups having 1–30 carbon atoms, such as methoxy, ethoxy, isopropoxy, t-butoxy, n-octyloxy and 2-methoxyethoxy groups. Suitable examples of the aryloxy groups include unsubstituted or substituted aryloxy groups having 6–30 carbon atoms, such as phenoxy, 2-methylphenoxy, 4-t-butylphenoxy, 3-nitrophenoxy, 2-tetradecanoylaminophenoxy groups. Suitable examples of the silyloxy groups include silyloxy groups having 3–20 carbon atoms, such as trimethylsilyloxy and t-butyldimethylsilyloxy groups. Suitable examples of the heterocyclyloxy groups include unsubstituted or substituted heterocyclyloxy groups having 2–30 carbon atoms, such as 1-phenyltetrazole-5-oxy and 2-tetrahydropyranyloxy groups. Suitable examples of the acyloxy groups include formyloxy group, unsubstituted or substituted alkylcarbonyloxy groups having 2–30 carbon atoms, such as acetyloxy, pivaroyloxy and stearoyloxy groups, and unsubstituted or substituted arylcarbonyloxy groups having 6–30 carbon atoms, such as benzoyloxy and p-methoxyphenylcarbonyloxy groups. Suitable examples of the carbamoyloxy groups include substituted or unsubstitured carbamoyloxy groups having 1–30 carbon atoms, such as N,N-dimethylcarbamoyloxy, N,N-diethylcarbamoyloxy, morpholinocarbonyloxy, N,N-di-n-octylaminocarbonyloxy and N-n-octylcarbamoyloxy groups. Suitable examples of the alkoxycarbonyloxy groups include unsubstituted or substituted alkoxycarbonyloxy groups having 2–30 carbon atoms, such as methoxycarbonyloxy, ethoxycarbonyloxy, t-butoxycarbonyloxy and n-octylcarbonyloxy groups. Suitable examples of the aryloxycarbonyloxy groups include unsubstituted or substituted aryloxycarbonyloxy groups having 7–30 carbon atoms, such as phenoxycarbonyloxy, p-methoxyphenoxycarbonyloxy and p-n-hexadecyloxyphenoxycarbonyloxy groups. Suitable examples of the amino groups include amino group, unsubstituted or substituted alkylamino groups having 1–30 carbon atoms, such as amino, methylamino and dimethylamino groups, and unsubstituted or substituted anilino groups having 6–30 carbon atoms, such as anilino, N-methylanilino and diphenylamino groups. Suitable examples of the acylamino groups include formylamino group, unsubstituted or substituted alkylcarbonylamino groups having 1–30 carbon atoms, such as formylamino, acetylamino, pivaroylamino and lauroylamino groups, and arylcarbonylamino groups having 6–30 carbon atoms, such as benzoylamino and 3,4,5-tri-n-octyloxyphenylcarbonylamino groups. Suitable examples of the aminocarbonylamino groups include unsubstituted or substituted aminocarbonylamino groups having 1–30 carbon atoms, such as carbamoylamino, N,N-dimethylaminocarbonylamino, N,N-diethylaminocarbonylamino and morpholinocarbonylamino groups. Suitable examples of the alkoxycarbonylamino groups include unsubstituted or substituted alkoxycarbonylamino groups having 2–30 carbon atoms, such as methoxycarbonylamino, ethoxycarbonylamino, t-butoxycarbonylamino, n-octadecyloxycarbonylamino and N-methyl-methoxycarbonylamino groups. Suitable examples of the aryloxycarbonylamino groups include unsubstituted or substituted aryloxycarbonylamino groups having 7–30 carbon atoms, such as phenoxycarbonylamino, p-chlorophenoxycarbonylamino and m-n-octyloxyphenoxycarbonylamino groups. Suitable examples of the sulfamoylamino groups include unsubstituted or substituted sulfamoylamino groups having 0–30 carbon atoms, such as sulfamoylamino, N,N-dimethylaminosulfonylamino and N-n-octylaminosulfonyl-amino groups. Suitable examples of the alkyl- and arylsulfonylamino groups include unsubstituted or substituted alkylsulfonylamino groups having 1–30 carbon atoms and unsubstituted or substituted arylsulfonylamino groups having 6–30 carbon atoms, such as methylsulfonylamino, butylsulfonylamino, phenylsulfonylamino, 2,3,5-trichlorophenylsulfonylamino and p-methylphenyl-sulfonylamino groups. Suitable examples of the alkyltho groups include unsubstituted or substituted alkylthio groups havin 1–30 carbon atoms, such as methylthio, ethylthio and n-hexadecylthio groups. Suitable examples of the arylthio groups include unsubstituted or substituted arylthio groups having 6–30 carbon atoms, such as phenylthio, p-chlorophenylthio and m-methoxyphenylthio groups. Suitable examples of the heterocyclylthio groups include unsubstituted or substituted heterocyclylthio groups having 2–30 carbon atoms, such as 2-benzothiazolylthio and 1-phenyltetrazole-5-ylthio groups. Suitable examples of the sulfamoyl groups include unsubstituted or substituted sulfamoyl groups having 0–30 carbon atoms, such as N-ethylsulfamoyl, N-(3-dodecyloxypropyl) sulfamoyl, N,N-dimethylsulfamoyl, N-acetylsulfamoyl, N-benzoylsulfamoyl and N-(N'-phenylcarbamoyl)sulfamoyl groups. Suitable examples of the alkyl- and arylsulfinyl groups include unsubstituted or substituted alkylsulfinyl groups having 1–30 carbon atoms and unsubstituted or substituted arylsulfinyl groups having 6–30 carbon atoms, such as methylsulfinyl, ethylsulfinyl, phenylsulfinyl and p-methylphenylsulfinyl groups. Suitable examples of the alkyl- and arylsulfonyl groups include unsubstituted or substituted alkylsulfonyl groups having 1–30 carbon atoms and unsubstituted or substituted arylsulfonyl groups having 6–30 carbon atoms, such as methylsulfonyl, ethylsulfonyl, phenylsulfonyl and p-methylphenylsulfonyl groups. Suitable examples of the acyl groups include formyl group, unsubstituted or substituted alkylcarbonyl groups having 2–30 carbon atoms and unsubstituted or substituted arylcarbonyl groups having 7–30 carbon atoms, such as acetyl, pivaroyl, 2-chloroacetyl, stearoyl, benzoyl and p-n-octyloxyphenylcarbonyl groups. Suitable examples of the aryloxycarbonyl groups include unsubstituted or substituted aryloxycarbonyl groups having 7–30 carbon atoms, such as phenoxycarbonyl, o-chlorophenoxycarbonyl, m-nitrophenoxycarbonyl and p-t-butylphenoxycarbonyl groups. Suitable examples of the alkoxycarbonyl groups include unsubstituted or substituted alkoxycarbonyl groups having 2–30 carbon atoms, such as methoxycarbonyl, ethoxycarbonyl, t-butoxycarbonyl and n-octadecyloxycarbonyl groups. Suitable examples of the carbamoyl groups include unsubstituted or substituted carbamoyl groups having 1–30 carbon atoms, such as carbamoyl, N-methylcarbamoyl, N,N-dimethylcarbamoyl, N,N-di-n-octylcarbamoyl and N-(methylsulfonyl) carbamoyl groups. Suitable examples of the aryl- and heterocyclylazo groups include unsubstituted or substituted arylazo groups having 6–30 carbon atoms and unsubstituted or substituted heterocyclylazo groups having 3–30 carbon atoms, such as phenylazo, p-chlorophenylazo and 5-ethylthio-1,3,4-thiadiazole-2-ylazo groups. Suitable examples of the imido groups include N-succinimido and N-phthalimido groups. Suitable examples of the phosphino groups include unsubstituted or substituted phosphino groups having 2–30 carbon atoms, such as dimethylphosphino, diphenylphosphino and methylphenoxy-phosphino groups. Suitable examples of the phosphonyl groups include unsubstituted or substituted phosphinyl groups having 2–30 carbon atoms, such as phosphinyl, dioctyloxyphosphinyl and diethoxypho sphinyl groups. Suitable examples of the phosphinyloxy groups include unsubstituted or substituted phosphinyloxy groups having 2–30 carbon atoms, such as diphenoxyphosphinyloxy and dioctyloxyphosphinyloxy groups. Suitable examples of the phosphinylamino groups include unsubstituted or substituted phosphinylamino groups having 2–30 carbon atoms, such as dimethoxyphosphinylamino and dimethylaminophosphinylamino groups. Suitable examples of the silyl groups include unsubstituted or substituted silyl groups having 3–30 carbon atoms, such as trimethylsilyl, t-butyldimethylsilyl and phenyldimethylsilyl groups.

Additionally, when the functional groups described as the substituents have hydrogen atoms, any of those hydrogen atoms may be substituted with any of the groups as described above.

Of the substituents which the alkyl, aryl or/and heterocyclic groups of a thioether compound represented by $L^1$ in formula (2) may have, preferred ones are halogen atoms, alkyl groups, alkenyl groups, alkynyl groups, aryl groups, heterocyclic groups, a cyano group, a hydroxyl group, a carboxyl group, alkoxy groups, aryloxy groups, heterocyclyloxy groups, acyloxy groups, carbamoyloxy groups, alkoxycarbonyloxy groups, aryloxycarbonyloxy groups, amino groups, acylamino groups, aminocarbonylamino groups, alkoxycarbonylamino groups, aryloxycarbonylamino groups, alkyl- and arylsulfonylamino groups, alkylthio groups, heterocyclylthio groups, sulfamoyl groups, a sulfo group, alkyl- and arylsulfonyl groups, acyl groups, aryloxycarbonyl groups, alkoxycarbonyl group, carbamoyl groups, imido groups, phosphino groups, phosphinyl groups, phosphinyloxy groups, phosphinylamino groups and silyl groups. And particularly preferred ones are halogen atoms, alkyl groups, alkenyl groups, alkynyl groups, aryl groups, heterocyclyl groups, a cyano group, a hydroxyl group, a carboxyl group, alkoxy groups, aryloxy groups, heterocyclyloxy groups, acyloxy groups, carbamoyl groups, alkoxycarbonyloxy groups, aryloxycarbonyloxy groups, amino groups, acylamino groups, aminocarbonylamino groups, alkoxycarbonylamino groups, aryloxycarbonylamino groups, alkyl- and arylsulfonylamino groups, alkylthio groups, arylthio groups, heterocyclylthio groups, sulfamoyl groups, a sulfo group, alkyl- and arylsulfonyl groups, acyl groups, aryloxycarbonyl groups, alkoxycarbonyl groups, carbamoyl groups, phosphinyl groups and phosphinyloxy groups.

When the alkyl, aryl or/and heterocyclic groups of a thioether compound represented by $L^1$ in formula (2) have substituents, it is preferable that those substituents be water-soluble groups. The term "water-soluble groups" in the present invention is intended to include acidic functional groups and salts thereof, preferably acidic functional groups capable of forming Brønsted acids, particularly preferably functional groups having pKa values of 7 or below in water. The acidic functional groups preferable for the present invention are a carboxyl group, a sulfo group and phosphorus-containing acidic functional groups. In particular, carboxyl and sulfo groups are advantageous over the others. When the substituents are salts of acidic functional groups, alkali metal salts (e.g., sodium and potassium salts), alkaline earth metal salts (e.g., Ca, Mg and Ba salts), ammonium salts, phosphonium salts and sulfonium salts of the acidic functional groups described above are suitable. When the salts of acidic functional groups are ammonium, phosphonium and sulfonium salts, it is also preferable for them to be inner salts.

The selenoether compound represented by $L^1$ in formula (2) is a selenoether compound wherein alkyl, aryl or/and heterocyclic groups are bound to the selenium atom. Substitution of these groups may be symmetrical or asymmetical about the selenium atom. Examples of such a compound include dialkyl selenoethers, diaryl selenothers, diheterocyclic selenoethers, alkyl-aryl selenoethers, alkyl-heterocyclic selenoethers and aryl-heterocyclic selenoethers. The selenoether compounds preferable for the present invention are symmetric or asymmetric dialkyl selenoethers, diaryl selenoethers and alkyl-aryl selenoethers.

The alkyl, aryl or/and heterocyclic groups of a selenoether compound represented by $L^1$ in formula (2) have the same meanings as those in the thioether compound as $L^1$, and suitable examples thereof are also the same as those in the thioether compound's case.

The telluroether compound represented by $L^1$ in formula (2) is a telluroether compound wherein alkyl, aryl or/and heterocyclic groups are bound to the tellurium atom. Substitution of these groups may be symmetrical or asymmetical about the tellurium atom. Examples of such a compound include dialkyl telluroethers, diaryl telluroethers, diheterocyclic telluroethers, alkyl-aryl telluroethers, alkyl-heterocyclic telluroethers and aryl-heterocyclic telluroethers. The telluroether compounds preferable for the present invention are symmetric or asymmetric dialkyl telluroethers, diaryl telluroethers and alkyl-aryl telluroethers.

The alkyl, aryl or/and heterocyclic groups of a telluroether compound represented by $L^1$ in formula (2) have the same meanings as those in the thioether compound as $L^1$, and suitable examples thereof are also the same as those in the thioether compound's case.

The disulfido group-containing compound represented by $L^1$ in formula (2) is a disulfide compound wherein alkyl, aryl or/and heterocyclic groups are bound to the sulfur atoms. Substitution of these groups may be symmetrical or asymmetical about the disulfido group. Examples of such a compound include dialkyl disulfides, diaryl disulfides, diheterocyclic disulfides, alkyl-aryl disulfides, alkyl-heterocyclic disulfides and aryl-heterocyclic disulfides. The disulfides preferable for the present invention are symmetric or asymmetric dialkyl disulfides, diaryl sulfides and alkyl-aryl disulfides.

The alkyl, aryl or/and heterocyclic groups of a disulfide compound represented by $L^1$ in formula (2) have the same meanings as those in the thioether compound as $L^1$, and suitable examples thereof are also the same as those in the thioether compound's case.

The diselenido group-containing compound represented by $L^1$ in formula (2) is a diselenide compound wherein alkyl, aryl or/and heterocyclic groups are bound to the selenium atoms. Substitution of these groups may be symmetrical or asymmetical about the diselenido group. Examples of such a compound include dialkyl diselenides, diaryl diselenides, diheterocyclic diselenides, alkyl-aryl diselenides, alkyl-heterocyclic diselenides and aryl-heterocyclic diselenides. The diselenides preferable for the present invention are symmetric or asymmetric dialkyl diselenides, diaryl selenides and alkyl-aryl diselenides.

The alkyl, aryl or/and heterocyclic groups of a diselenide compound represented by $L^1$ in formula (2) have the same meanings as those in the thioether compound as $L^1$, and suitable examples thereof are also the same as those in the thioether compound's case.

The ditellurido group-containing compound represented by $L^1$ in formula (2) is a ditelluride compound wherein alkyl, aryl or/and heterocyclic groups are bound to the tellurium atoms. Substitution of these groups may be symmetrical or asymmetical about the ditellurido group. Examples of such a compound include dialkyl ditellurides, diaryl distellurides, diheterocyclic ditellurides, alkyl-aryl ditellurides, alkyl-heterocyclic ditellurides and aryl-heterocyclic ditellurides. The ditellurides preferable for the present invention are symmetric or asymmetric dialkyl ditellurides, diaryl tellurides and alkyl-aryl ditellurides.

The alkyl, aryl or/and heterocyclic groups of a ditelluride compound represented by $L^1$ in formula (2) have the same meanings as those in the thioether compound as $L^1$, and suitable examples thereof are also the same as those in the thioether compound's case.

When the $L^1$ in formula (2) is a thioamido group-containing compound, the thioamido group may be part of a ring structure, or an acyclic thioamido group. The thoamido groups useful for the present invention can be selected from those disclosed in U.S. Pat. Nos. 4,030,925, 4,031,127, 4,080,207, 4,245,037, 4,255,511, 4,266,031 and 4,276,364, or Research Disclosure, vol. 151, Item 15162 (November 1976) and vol. 176, Item 17626 (December 1978). Suitable examples of a thioamido group-containing compound as $L^1$ include thiourea, thiourethane, dithiocarbaminic acid esters, 4-thiazoline-2-thione, thiazolidine-2-thione, 4-oxazoline-2-thione, oxazolidine-2-thione, 2-pyrazoline-5-thione, 4-imidazoline-2-thione, 2-thiohydantoin, rhodanine, isorhodanine, 2-thio-2,4-oxazolidinedione, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione. These thioamide compounds may further have substituent groups.

When the $L^1$in formula (2) is a selenoamido or telluroamido group-containing compound, examples of such a compound include compounds substituting selenium or tellurium atoms for the sulfur atoms in the thioamide compounds described above.

When the $L^1$ in formula (2) is a compound having a 5- or 6-membered nitrogen-containing heterocyclic group, the hetero ring present therein is a 5- or 6-membered nitrogen-containing hetero ring made up of a combination of nitrogen, oxygen, sulfur and carbon atoms. When the compound as $L^1$ has a nitrogen-containing heterocyclic group, suitable examples thereof include benzotriazole, triazole, tetrazole, indazole, benzimidazole, imidazole, benzothiazole, thiazole, thiazoline, benzoxazole, benzoxazoline, oxazole, thiadiazole, oxadiazole, triazine, pyrrole, pyrrolidine, imidazolidine and morpholine. These compounds each may have an preferable substituent. Of these compounds, benzotriazole, triazole, tetrazole and indazole are preferred over the others. In particular, benzotriazole is favorable.

When an amino group is contained in the compound as $L^1$ in formula (2), suitable examples thereof include an unsubstituted amino group, unsubstituted or substituted alkylamino groups having 1–30 carbon atoms and unsubstituted or substituted anilino groups having 6–30 carbon atoms.

When the $L^1$ in formula (2) is a compound containing a phosphino group, the suitable substituent which the phosphino group can have is an alkyl group having 1–20 carbon atoms, an aryl group having 6–30 carbon atoms, an alkoxy group having 1–20 carbon atoms, an aryloxy group having 6–30 carbon atoms an alkylamino group having 1–20 carbon atoms or an arylamino group having 6–30 carbon atoms.

Compounds suitable as $L^1$ in the present invention are compounds containing thioether groups, selenoether groups, telluroether groups, thioamido groups, selenoamido groups, telluroamido groups, amino groups, phosphino groups or 5- to 6-membered nitrogen-containing heterocyclic groups. Further, thioamido groups, selenoamido groups, telluroamido groups, phosphino groups or 5- to 6-membered nitrogen-containing heterocyclic groups are more preferred. In particular, compounds containing phosphino groups or 5- to 6-membered nitrogen-containing heterocyclic groups are preferred.

Although as the gold-containing compounds of the present invention, gold-containing compounds of super fine grains having various sizes can be used, the suitable average size thereof on a equivalent sphere diameter is from 0.5 nm to 500 nm, preferably from 0.5 nm to 50 nm, much preferably from 0.5 nm to 10 nm, particularly preferably from 0.5 nm to 5 nm.

Examples of $L^1$ of the present invention are illustrated in Tables 1 to 4, and examples of a gold-containing compound represented by formula (2) in a state of super fine grain are shown in Table 5. However, these examples are not to be construed as limiting the scope of the present invention in any way.

TABLE 1

L-1

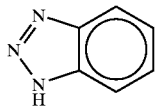

L-2

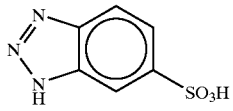

L-3

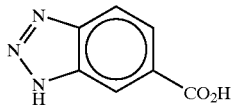

L-4

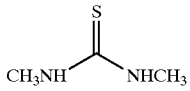

L-5

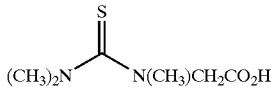

L-6

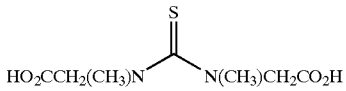

L-7

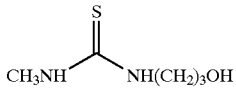

L-8

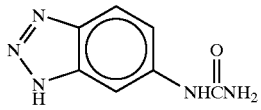

L-9

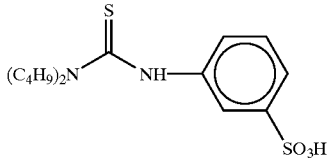

TABLE 1-continued

L-10

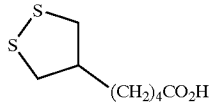

L-11

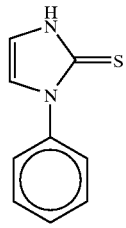

L-12

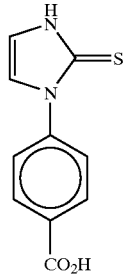

L-13

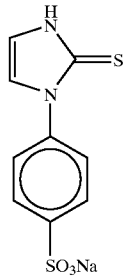

L-14

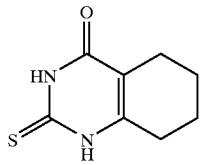

L-15

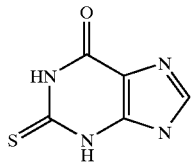

L-16

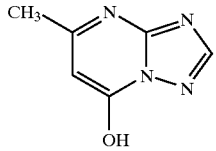

L-17

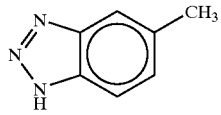

TABLE 1-continued
| | |
|---|---|
| L-18 | 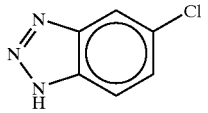 |
| L-19 | 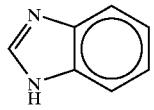 |
TABLE 1-continued
| | |
|---|---|
| L-20 | 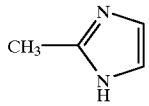 |
TABLE 2
| | |
|---|---|
| L-21 | 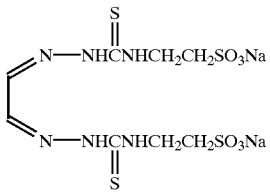 |
| L-22 | $HOCH_2CH_2SCH_2CH_2OH$ |
| L-23 | $HOCH_2CH_2SCH_2CH_2SCH_2CH_2OH$ |
| L-24 | $HOCH_2CH_2SCH_2CH_2SCH_2CH_2SCH_2CH_2OH$ |
| L-25 | $HO_2CCH_2SCH_2CH_2SCH_2CO_2H$ |
| L-26 | $HO_2CCH_2SCH_2CH_2SCH_2CH_2SCH_2CO_2H$ |
| L-27 | $NaO_3SCH_2CH_2SCH_2CH_2SCH_2CH_2SO_3Na$ |
| L-28 | $KO_3SCH_2CH_2SCH_2CH_2SCH_2CH_2SCH_2CH_2SO_3K$ |
| L-29 | $HOCH_2CH_2SeCH_2CH_2SeCH_2CH_2OH$ |
| L-30 | 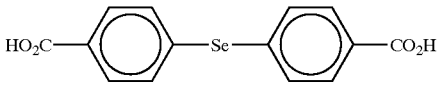 |
| L-31 | $HOCH_2CH_2TeCH_2CH_2OH$ |
| L-32 | $HOCH_2CH_2TeCH_2CH_2CH_2SO_3Na$ |
| L-33 | 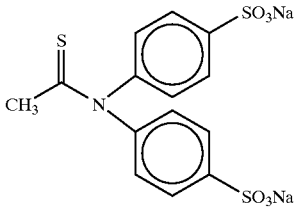 |
| L-34 | 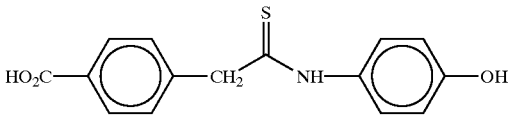 |
| L-35 | 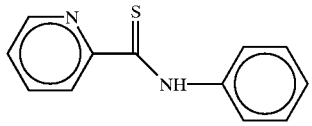 |

TABLE 2-continued
| | |
|---|---|
| L-36 | 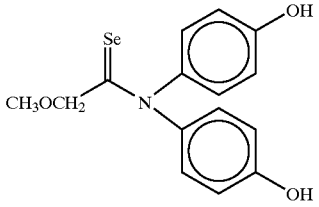 |
| L-37 | 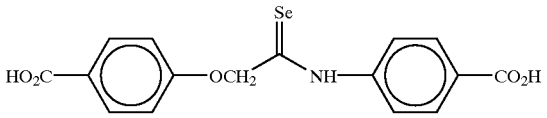 |
| L-38 | 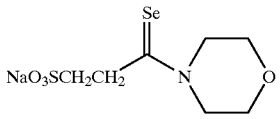 |
| L-39 | 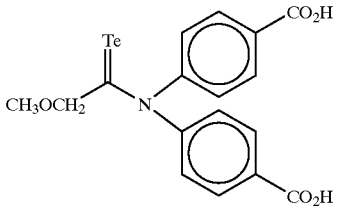 |
| L-40 | 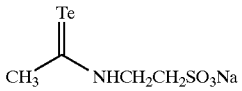 |
| L-41 | 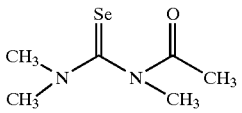 |
| L-42 | 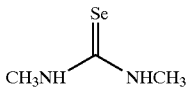 |
TABLE 3
| | |
|---|---|
| L-43 | 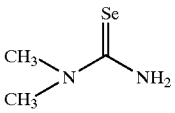 |
| L-44 | 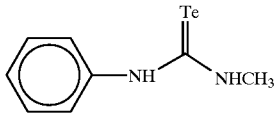 |
| L-45 | 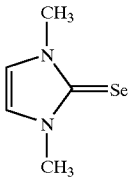 |

TABLE 3-continued
| | |
|---|---|
| L-46 | 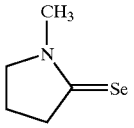 |
| L-47 | $P(CH_2CH_2CH_2CH_3)_3$ |
| L-48 | $Ph—P(CH_2CH_3)_2$ |
| L-49 | $PPh_3$ |
| L-50 | 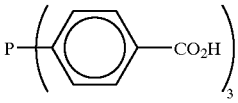 |
| L-51 | 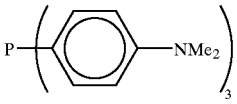 |
| L-52 | 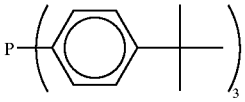 |
| L-53 | $H_2NCH_2CH_2CH_2CH_2NH_2$ |
| L-54 | 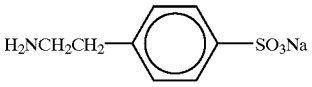 |
| L-55 | $H_2N(CH_2CH_2O)_2CH_2CH_2OEt$ |
| L-56 | $N(CH_2CH_3)_3$ |
| L-58 | $N(CH_2CH_2OCH_2CH_2OCH_3)_3$ |
| L-59 | 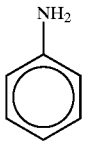 |
| L-60 | 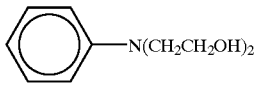 |
| L-61 | $P(OCH_2CH_3)_3$ |
| L-62 | $P(N(CH_2CH_3)_2)_3$ |
| L-63 | $HOCH_2\underset{\underset{OH}{\vert}}{C}HCH_2SSCH_2\underset{\underset{OH}{\vert}}{C}HCH_2OH$ |
| L-64 | 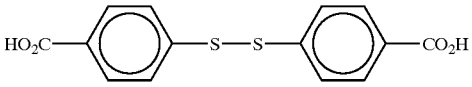 |
| L-65 | $HO_2C\overset{\overset{NH_2}{\vert}}{C}HCH_2SSCH_2\overset{\overset{NH_2}{\vert}}{C}HCO_2H$ |
| L-66 | 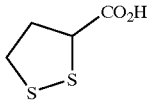 |

TABLE 3-continued
| | |
|---|---|
| L-67 | $(CH_3)_3\overset{+}{N}CH_2CH_2SSCH_2CH_2\overset{+}{N}(CH_3)_3$ 2I⁻ |
| L-68 | 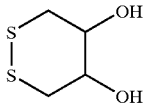 |
| L-69 | 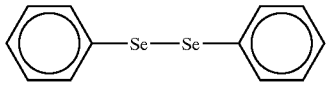 |
| L-70 | $C_4H_9—S—CH(CH_3)—Se—Se—CH(CH_3)—S—C_4H_9$ |
| L-71 | 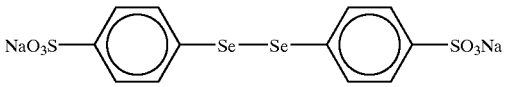 |
TABLE 4
| | |
|---|---|
| L-73 | 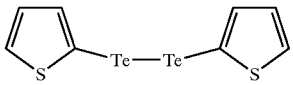 |
| L-74 | 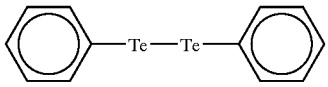 |
| L-75 | 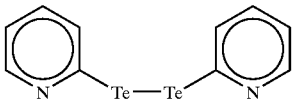 |
| L-76 | $C_4H_9—Te—Te—C_4H_9$ |
| L-77 | 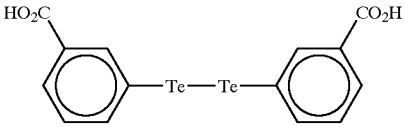 |
| L-78 | 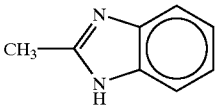 |
| L-79 | 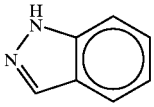 |
| L-80 | 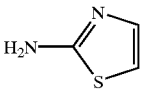 |
| L-81 | 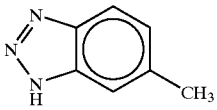 |
TABLE 4-continued
| | |
|---|---|
| L-82 | 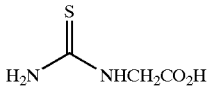 |
| L-83 | 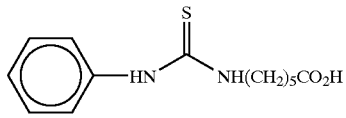 |
| L-84 | 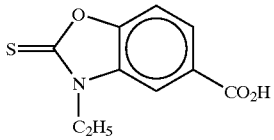 |
| L-85 | 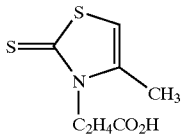 |
| L-86 | 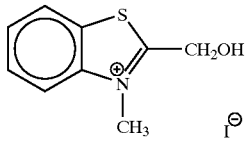 |
| L-87 | 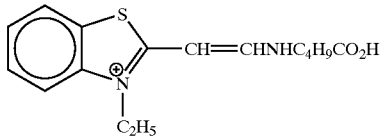 |
| L-88 | 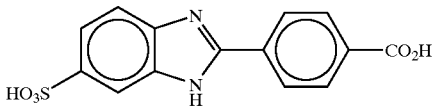 |

TABLE 4-continued

L-89

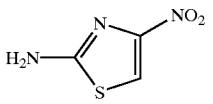

L-90

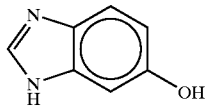

L-91

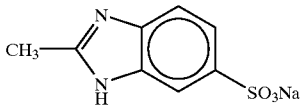

L-92

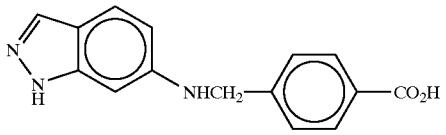

L-93

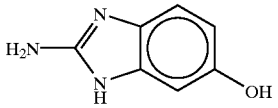

L-94

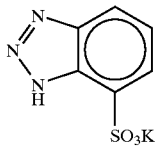

L-95

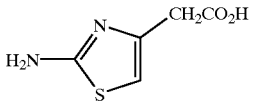

L-96

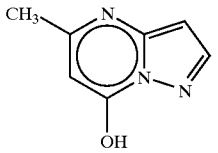

L-97

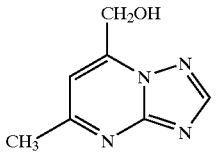

TABLE 5

| Present Gold-containing compound in super fine grain state | L | n |
|---|---|---|
| G-1 | L-1 | 0.22 |
| G-2 | L-3 | 0.30 |
| G-3 | L-5 | 0.23 |
| G-4 | L-7 | 0.18 |
| G-5 | L-8 | 0.18 |
| G-6 | L-10 | 0.25 |
| G-7 | L-11 | 0.44 |
| G-8 | L-12 | 0.41 |

TABLE 5-continued

| Present Gold-containing compound in super fine grain state | L | n |
|---|---|---|
| G-9 | L-15 | 0.38 |
| G-10 | L-17 | 0.31 |
| G-11 | L-19 | 0.24 |
| G-12 | L-22 | 0.26 |
| G-13 | L-23 | 0.33 |
| G-14 | L-25 | 0.45 |
| G-15 | L-27 | 0.21 |
| G-16 | L-30 | 0.31 |
| G-17 | L-31 | 0.28 |
| G-18 | L-33 | 0.29 |
| G-19 | L-34 | 0.33 |
| G-20 | L-36 | 0.19 |
| G-21 | L-40 | 0.23 |
| G-22 | L-41 | 0.41 |
| G-23 | L-43 | 0.39 |
| G-24 | L-45 | 0.41 |
| G-25 | L-47 | 0.22 |
| G-26 | L-49 | 0.29 |
| G-27 | L-50 | 0.19 |
| G-28 | L-51 | 0.24 |
| G-29 | L-53 | 0.50 |
| G-30 | L-56 | 0.39 |
| G-31 | L-60 | 0.29 |
| G-32 | L-61 | 0.37 |
| G-33 | L-62 | 0.26 |
| G-34 | L-63 | 0.34 |
| G-35 | L-66 | 0.20 |
| G-36 | L-67 | 0.27 |
| G-37 | L-68 | 0.23 |
| G-38 | L-69 | 0.37 |
| G-39 | L-71 | 0.32 |
| G-40 | L-73 | 0.35 |

In synthesizing super fine grains of each gold-containing compound represented by formula (2), most suitable method therefor is chosen depending on the compound composition, so synthesis methods to be adopted therein cannot be generalized. However, the compounds of the present invention can be synthesized by reference to known methods as described in *Langmuir*, vol. 15, p. 1075 (1999). For explaining usable synthesis methods, a synthesis example of a representative of the gold-containing compounds of the present invention represented by formula (2) is shown below.

(Synthesis of Gold-containing Compound G-2 in Super Fine Grain State)

To 4 ml of water was added 206 mg of chloroauric acid tetrahydrate, and further added 100 ml of methanol solution in which 150 mg of L-3 was dissolved. To this solution, 25 ml of an aqueous solution containing 190 mg of sodium borohydride was slowly added dropwise. The resulting solution was centrifuged, and the supernatant liquid was removed therefrom. To the residue was added 25 ml of an aqueous solution containing 20% of methanol, and applied ultrasonic waves for 30 minutes. Then, the supernatant liquid was removed through centrifugation. This dispersion-and-centrifugation operation was further repeated twice. Thus, 320 mg of a gold-containing compound was obtained as super fine grains. By elemental analysis, it was found that these compounds have a composition of $AuL_{0.30}$.

The suitable addition amount of the gold-containing compounds represented by formula (1) of the present invention is from $1\times10^{-8}$ to $1\times10^{-2}$ Mole, preferably from $1\times10^{-6}$ to $1\times10^{-3}$ mole, based on Au(0) per mole of silver halide.

The gold-containing compounds represented by formula (1) of the present invention maybe added using water, alcohol (e.g., methanol, ethanol), a ketone (e.g., acetone), an amide (e.g., dimethylformamide), a glycol (e.g., methylpropylene glycol) or an ester (e.g., ethyl acetate) as a solvent or a dispersion medium.

The gold-containing compounds represented by formula (1) of the present invention can be added at any stage in the emulsion-making process. However, it is preferable that they be added during the period from after formation of silver halide grains to conclusion of chemical sensitization.

Silver halide emulsions used in the silver halide photosensitive materials of the present invention have no particular restriction as to the silver halide comprised therein, and so any of silver chloride, silver chlorobromide, silver bromide, silver iodochloride and silver iodobromide can be used therein. Particularly, emulsions containing bromide ions or iodide ions are advantageous in the present invention. Although silver halide emulsion grains used in the present invention have no particular restriction as to their sizes, it is suitable for them to have the equivalent sphere diameters of 0.01 to 3 $\mu$m. The silver halide grains may have a regular (normal) crystal form or an irregular crystal form. The normal crystal form includes crystal forms of a cube, an octahedron, a dodecahedron, a tetradecahedron, an eicosahedron and an octatetraconta-hedron; while the irregular crystal form includes a spherical crystal form and a pebble-like crystal form. In addition, the silver halide grains used may assume a crystal form having at least one twin plane. Specifically, grains of a square or triangular tabular form having two or three parallel twin planes are used to advantage. Further, it is preferable for the grains having such tabular forms to be monodisperse (10 to 20% in variation coefficient) with respect to the grain size distribution. The preparation of monodisperse tabular grains is described in Japanese Patent Application (Laid-Open) No. 11928/1988. The description of monodisperse tabular hexagonal grains is found in Japanese Patent Application (Laid-Open) No. 151618/1988. The monodisperse emulsion comprising tabular circular grains is described in Japanese Patent Application (Laid-Open) No. 131541/1989. Further, Japanese Patent Application (Laid-Open) No. 838/1990 discloses the emulsion wherein at least 95%, based on projected area, of the total grains are tabular grains having two twin planes parallel to the main plane and the size distribution of these tabular grains is monodisperse. EP-A-0514742 discloses the tabular-grain emulsion prepared in the presence of a polyalkylene oxide block polymer and thereby achieving a variation coefficient of 10% or below with respect to the grain size distribution. By adopting these techniques, monodisperse emulsion grains suitable for the present invention can be prepared.

In addition, the suitable variation coefficient of the grain thickness distribution is 20% or below, particularly from 5 to 15%.

Further, there are known tabular grains of two types, specifically tabular grains having (100) main planes and those having (111) main planes. As to silver bromide, the tabular grains of the former type are disclosed in U.S. Pat. No. 4,063,951 and Japanese Patent Application (Laid-Open) No. 281640/1993. As to silver chloride, the tabular grains of the former type are disclosed in EP-A1-0534395 and U.S. Pat. No. 5,264,337. The tabular grains of the latter type can have various shapes wherein at least one twin plane is present. As to the tabular grains of the latter type, the description of silver chloride can be found in U.S. Pat. Nos. 4,399,215, 4,983,508 and 5,183,732, Japanese Patent Application (Laid-Open) Nos. 137632/1991 and 116113/1991. The present invention can be applied preferably to both tabular grains having (100) main planes and those having (111) main planes.

The tabular-grain emulsions used to advantage in the present invention are such emulsions that at least 50% (on an area basis) of the total silver halide grains present in each emulsion are silver halide grains having aspect ratios (equivalent circle diameter/grain thickness ratio) of at least 2 (preferably 100 or less). In the emulsions each, it is preferable that at least 50% (on an area basis), preferably at least 60%, particularly preferably at least 85%, of the total silver halide grains be silver halide grains having aspect ratios of at least 5, preferably at least 8.

The suitable equivalent circle diameter of tabular grains is from 0.2 to 5.0 $\mu$m, preferably from 0.5 to 3.0 $\mu$m, particularly preferably from 0.6 to 2.0 $\mu$m. The suitable thickness of tabular grains is from 0.02 to 0.3 $\mu$m, particularly from 0.03 to 0.2 $\mu$m.

Also in the case of internal latent image type direct-positive silver halide emulsions, ranges similar to those for the tabular-grain emulsions are preferable. Specifically, it is advantageous for the direct-positive emulsions each to contain silver halide grains at least 50% (preferably at least 70%, particularly preferably at least 85%, on an area basis) of which are silver halide grains having an average grain diameter (equivalent circle diameter) of at least 0.3 $\mu$m (preferably from 0.3 to 10 $\mu$m, much preferably from 0.5 to 5.0 $\mu$m, particularly preferably from 0.5 to 3.0 $\mu$m) and aspect ratios of at least 2, preferably at least 5, particularly preferably at least 8 (preferably 100 or less).

The silver halide grains may have dislocation lines on the inside. The art of introducing dislocations into silver halide grains under control is disclosed in Japanese Patent Application (Laid-Open) No. 220238/1988. According to this reference, the dislocation can be introduced by forming a particular phase having a high iodide content inside the tabular silver halide grains having an aspect ratio of at least 2 and covering the outside with a phase lower in iodide content than the aforesaid phase having a high iodide content. The introduction of such a dislocation can produce various effects, including an increase in sensitivity, improvement in keeping quality, a rise in latent image stability and reduction in pressure fog. By the use of such an art, the dislocations are introduced mainly in the edge part of tabular grains. On the other hand, the tabular grains having dislocations introduced in the core part are disclosed in U.S. Pat. No. 5,238,796. The present invention can produce its effect on emulsions each wherein at least 50%, on a number basis, of the total silver halide grains are grains having at least 10 dislocation lines per one grain.

The preparation of silver halide emulsions has no particular restrictions on additives used from the grain formation step till the coating step. For the purpose of promoting the crystal growth in the crystallization step or achieving effective chemical sensitization at time of grain formation and/or chemical sensitization, silver halide solvents can be utilized. As preferable silver halide solvents, it is possible to use water-soluble thiocyanates, ammonia, thioethers and thioureas. Suitable examples of silver halide solvents include the thiocyanates disclosed in U.S. Pat. Nos. 2,222,264, 2,448,534 and 3,320,069, ammonia, the thioether compounds disclosed in U.S. Pat. Nos. 3,271,157, 3,574,628, 3,704,130, 4,297,439 and 4,276,347, the thione compounds disclosed in Japanese Patent Application (Laid-Open) Nos. 144319/1978, 82408/1978 and 77737/1980, the amine compounds disclosed in Japanese Patent Application (Laid-Open) No. 100717/1979, the thiourea derivatives disclosed in Japanese Patent Application (Laid-Open) No. 2982/1980, the imidazoles disclosed in Japanese Patent Application (Laid-Open) No. 100717/1979, and the substituted mercaptotetrazoles disclosed in Japanese Patent Application (Laid-Open) No. 202531/1982.

The present invention has no particular restrictions on preparation method of silver halide emulsions. In general, aqueous silver salt and halide solutions are added to a reaction solution including an aqueous gelatin solution under efficient agitation. The methods usable therein are described in, e.g., P. Glafkides, *Chemie et Physique Photographique*, Paul Montel (1967), G. F. Dufin, *Photographic Emulsion Chemistry*, The Focal Press (1966), and V. L. Zelikman, et al., *Making and Coating Photographic Emulsion*, The Focal Press (1964). More specifically, any of acid, neutral and ammonia methods may be adopted for emulsion-making, and the methods employed for reacting a water-soluble silver salt with a water-soluble halide may be any of a single jet method, a double jet method and a combination thereof. In addition, it is also desirable that the emulsion grains be made to grow at the highest speed under the critical supersaturation limit by the use of the method of altering the addition speeds of aqueous silver nitrate and alkali halide solutions in proportion to the grain growth speed (as disclosed in U.K. Patent No. 1,535,016, Japanese Patent Publication Nos. 36890/1973 and 16364/1977) or the method of changing the concentrations of aqueous solutions (as disclosed in U.S. Pat. No. 4,24,445 and Japanese Patent Application (Laid-Open) No. 158124/1980). These methods can be employed to advantage, because they cause no re-nucleation and ensure uniform growth of silver halide grains.

In another method which can be used to advantage, previously prepared fine grains are added to a reaction vessel instead of adding silver salt and halide solutions to a reaction vessel, thereby causing nucleation and/or grain growth to prepare silver halide grains. For details of the arts concerning this method Japanese Patent Application (Laid-Open) Nos. 183644/1989, 183645/1989, 44335/1990, 43534/1990 and 43535/1990 and U.S. Pat. No. 4,879,208 can be referred to. According to this method, the halide ion distribution inside the emulsion grains can be uniform throughout to provide desirable photographic characteristics. Furthermore, emulsion grains having various structures can be employed in the present invention. For instance, the grains constituted of an inner part (core part) and the outside thereof (shell part), or the grains having the so-called core/shell double-layer structure, the grains having a triple-layer structure (as disclosed in Japanese Patent Application (Laid-Open) No.222844/1985) and the grain shaving a multi-layer structure can be used. In the case of forming emulsion grains so as to have a structure on the inside, the structure on the inside may be not only the wrapped-in structure as described above but also the so-called junction structure. Examples of these structures are disclosed in Japanese Patent Application (Laid-Open) Nos. 108526/1983, 16254/1984 and 133540/1984, Japanese Patent Publication No. 24772/1983 and EP-A2-0199290. Specifically, each host crystal joins crystallites having different compositions at its edge(s), corner(s) or face(s) and the crystallites grow on the joined site(s), thereby forming a crystal having a junction structure. In forming such junction crystals, the host crystal may have a uniform halide composition or a core/shell structure. The junction structures can be formed, as a matter of course, by combinations of silver halide crystals different in halide. Further, it is also possible to form junction structures by use of other silver salt compounds having a structure other than the rock salt structure, such as silver thiocyanate and silver carbonate, in combination with silver halide as long as they can form junction grains. In the present invention, it is most advantageous to use grains having a core/shell double-layer structure.

In the case of silver iodobromide grains having such an internal structure as described above, e.g., a core/shell structure, the iodide content may be high in the core part and low in the shell part. On the contrary, the iodide content may be low in the core part and high in the shell part. Also in the silver iodobromide grains having a junction structure, the iodide content may be high in the host crystal and relatively low in the crystal joined to the host crystal, or vice versa. When the grains have those structures, each boundary between the parts differing in halide composition may have a clear interface, or may be rendered obscure by forming mixed crystals depending on the difference in halide composition. Also, a continuous change in structure may be positively introduced in the boundary region. In the present invention, the silver halide emulsion is preferably a latent image type emulsion. However, as disclosed in Japanese Patent Application (Laid-Open) No. 133542/1984, it is also possible to use the internal latent image type emulsion so far as the developer or developing condition is chosen properly. Further, a shallow internal latent image type emulsion with a thin shell can be employed depending on the intended use.

In the present invention, it is preferable that at least either the core or the shell of individual grains be chemically sensitized by using the compound of formula (1) of the present invention, preferably under a condition that the pAg is from 5 to 10, the pH is from 4 to 8 and the temperature is from 30° C. to 80° C. In combination with the compound of formula (1), compounds as L in formula (1), gold sensitizers and other chemical sensitizers may be used. Representatives of the gold sensitizers are chloroauric acid and alkali salts thereof. Preferably, the core of individual grains is chemically sensitized with the compound of formula (1).

Additionally, it is not necessarily required that both the core and the shell undergo chemical sensitization with the compound of formula (1), but one or the other may be chemically sensitized by the combined use of a compound as L and a gold sensitizer, or by the use of other chemical sensitizers.

Tabular silver iodobromide emulsions suitably used in the present invention can be prepared by reference to the methods as disclosed in U.S. Pat. Nos. 4,439,520, 4,434,226, 4,433,048, 4,414,310 and 5,334,495.

For preparation of very thin tabular emulsions having a grain thickness of 0.1 $\mu$m or below, the methods disclosed in U.S. Pat. Nos. 5,460,928, 5,411,853 and 5,418,125 can be referred to.

For emulsions suitably employed when the present invention is applied to emulsions containing tabular grains high in silver chloride content, European Patents Nos. 723187, 619517, 534395 and 584644 can be referred to.

In general, the silver halide emulsions are spectrally sensitized. Suitable dyes for spectral sensitization are usually methine dyes. Examples of methine dyes include cyanine dyes, merocyanine dyes, complex cyanine dyes, complex merocyanine dyes, holopolar cyanine dyes, hemicyanine dyes, styryl dyes and hemioxonol dyes. The basic heterocyclic rings constituting these dyes may be any rings usually present in cyanine dyes. Examples of such basic heterocyclic rings, include pyrroline, oxazoline, thiazoline, pyrrole, oxazole, thiazole, selenazole, imidazole, tetrazole and pyridine rings. In addition to these rings, rings formed by condensed hetero rings as described above with alicyclic or aromatic hydrocarbon rings are usable. Examples of such condensed rings include indolenine, benzindolenine, indole, benzoxazole, naphthoxazole, benzothiazole, naphthothiazole, benzoselenazole, benzimidazole and quinoline rings. These rings each may have substituent groups on any of carbon atoms as the constituent atoms thereof. The merocyanine and complex merocyanine dyes can contain 5- or 6-membered heterocyclic rings having ketomethylene structure. Examples of such hetero rings include pyrazoline-5-one, thiohydantoin, 2-thioxazolidine-2,4-dione, thiazolidine-2,4-dione, rhodanine and thiobarbituric acid rings.

The suitable amount of sensitizing dyes added is from 0.001 to 100 millimoles, preferably from 0.01 to 10 millimoles, per mole of silver halide. It is advantageous to add the sensitizing dyes during chemical sensitization or before chemical sensitization (e.g., at the time of grain formation or physical ripening).

To silver halide emulsions, dyes which, though they themselves do not spectrally sensitize silver halide emulsions, or materials which, though they do not absorb light in the visible region, can exhibit a supersensitizing effect may be added in combination with certain sensitizing dyes. Examples of such dyes or materials include aminostilbene compounds substituted by nitrogen-containing heterocyclic groups (as disclosed in U.S. Pat. Nos. 2,933,390 and 3,635,721), aromatic organic acid-formaldehyde condensates (as disclosed in U.S. Pat. No. 3,743,510), cadmium salts and azaindene compounds. The combinations of sensitizing dyes with the above-described dyes or materials are disclosed in U.S. Pat. Nos. 3,615,613, 3,615,641, 3,617,295 and 3,635,721.

The silver halide emulsions are generally used after they undergone chemical sensitization. For the chemical sensitization, it is preferable that chalcogen sensitization (including sulfur sensitization, selenium sensitization and tellurium sensitization),noble metal sensitization (including gold sensitization) and reduction sensitization be carried out individually or as combinations thereof. As the chemical sensitization in the present invention, it is preferable to carry out sulfur sensitization or sulfur-gold sensitization in combination with the compound of formula (1). It is also favorable that selenium sensitization and/or tellurium sensitization is further carried out. In the sulfur sensitization, labile sulfur compounds are used as sensitizers. Examples of labile sulfur compounds are described in P. Glafkides, *Chimie et Physique Photographique*, 5th ed., Paul Montel (1987), *Research Disclosure* vol. 307, No. 307105, T. H. James (editor), *The Theory of The Photographic Process*, 4th ed., Macmillan (1977), and H. Frieser, *Die Gründlagender Photographischen Prozess mit Silver-Halogeniden*, Akademische Verlags-geselbshaft (1968). Suitable sulfur sensitizers which can be used include thiosulfates (such as sodium thiosulfate and p-toluenethiosulfonate), thioureas (such as diphenylthiourea, triethylthiourea, N-ethyl-N'-(4-methyl-2-thiazolyl)thiourea and carboxymethyltrimethylthiourea), thioamides (such as thioacetamide and N-phenylthioacetamide), rhodanines (such as rhodanine, N-ethylrhodanine, 5-benzylidenerhodanine, 5-benzylidene-N-ethylrhodanine and diethylrhodanine), phosphine sulfides (such as trimethylphosphine sulfide), thiohydantoins, 4-oxo-oxazolidine-2-thiones, dipolysulfides (such as dimorpholine disulfide, cystine and hexathiokane-thione), mercapto compounds (such as cysteine), polythionates and elemental sulfur. Also, active gelatins can be utilized as sulfur sensitizer.

In selenium sensitization, labile selenium compounds are used as sensitizers. Such labile selenium compounds are disclosed in Japanese Patent Application (Laid-Open) Nos. 13489/1968, 15748/1969, 25832/1992, 109240/1992, 271341/1992 and 40324/1993. Examples of selenium sensitizers include colloidal metallic selenium, selenoureas (such as N,N-dimethylselenourea, trifluoromethylcarbonyl-trimethyl-selenourea and acecyl-trimethylselenourea), selenoamides (such as selenoacetamide and N,N-diethylphenylselenoamide), phosphine selenides (such as triphenylphosphine selenide and pentafluorophenyl-triphenylphosphine selenide), seleno-phosphates (such as tri-p-tolylselenophosphate and tri-n-butylselenophosphate), selenoketones (such as selenobenzophenone), isoselenocyanates, selenocarboxylic acids, selenoesters and diacylselenides. In addition, moderately stable selenium compounds (as disclosed in Japanese Patent Publication Nos. 4553/1971 and 34492/1977), including selenious acid, potassium selenocyanide, selenazoles and selenides, can also be utilized as selenium sensitizers.

In tellurium sensitization, labile tellurium compounds are used as sensitizers. Such labile tellurium compounds are disclosed in Canadian Pat. No. 800,958, U.K. Patent Nos. 1,295,462 and 1,396,696, and Japanese Patent Application (Laid-Open) Nos. 204640/1992, 271341/1992, 333043/1992 and 303157/1993. Examples of tellurium sensitizers include telluroureas (such as tetramethyltellurourea, N,N'-dimethylethylenetellurourea and N,N'-diphenylethylenetellurourea), phosphine tellurides (such as butyldiisopropylphosphine telluride, tributyl-phosphine telluride, tributoxyphosphine telluride and ethoxydiphenylphosphine telluride), diacyl(di)tellurides (such as bis(diphenylcarbamoyl)ditelluride, bis(N-phenyl-N-methylcarbamoyl)ditelluride, bis(N-phenyl-N-methylcarbamoyl)telluride and bis(ethoxycarbonyl)telluride), isotellurocyanates (such as allylisotellurocyanate), telluroketones (such as telluroacetone and telluroacetophenone), telluroamides (such as telluroacetamide and N,N-dimethyltellurobenzamide), tellurohydrazides (such as N,N',N'-trimethyltellurobenzohydrazide), telluroesters (such as t-butyl-t-hexyltelluroester), colloidal tellurium, (di)tellurides and other tellurium compounds (such as potassium telluride and sodium telluropentathionate).

In noble metal sensitization, the salts of noble metals, such as gold, platinum, palladium and iridium, are used as sensitizers. Such noble metal salts are described in, e.g., P. Glafkides, *Chimie et Physique Photographique*, 5th ed., Paul Montel (1987), and *Research Disclosure*, vol. 307, No. 307105. In particular, gold sensitization is preferred over the others. Examples of gold compounds used for gold sensitization include chloroauric acid, potassium chloroaurate, potassium aurithiocyanate, gold sulfide and gold selenide. In addition, the gold compounds disclosed in U.S. Pat. Nos. 2,642,361, 5,049,484 and 5,049,485 can be used as gold sensitizers.

In the other mode of gold sensitization, the gold complexes disclosed in U.S. Pat. Nos. 5,700,631, 5,759,761 and 5,620,841, and Japanese Patent Application (Laid-Open) Nos. 266828/1991, 67032/1992 and 69074/1996 may be used.

In the present invention, reduction sensitization can be carried out in combination with the compound of the present invention.

In the reduction sensitization, reducing compounds are used as sensitizers. Such reducing compounds are described in, e.g., P. Glafkides, *Chimie et Physuque Photographique*, 5th ed., Paul Montel (1987), and *Research Disclosure*, vol. 307, No. 307105. Examples of reduction sensitizers include aminoiminomethanesulfinic acid (thiourea dioxide), borane compounds (such as dimethylamine borane), hydrazine compounds (such as hydrazine and p-tolylhydrazine), polyamine compounds (such as diethylenetriamine and triethylenetetramine), stannous chloride, silane compounds, reductones (such as ascorbic acid), sulfites, aldehyde compounds and hydrogen. In addition, reduction sensitization can be carried out in an atmosphere of high pH or excess silver ions (the so-called silver ripening).

Two or more kinds of chemical sensitization may be carried out in combination. In particular, the combination of chalcogen sensitization and gold sensitization is preferred. Further, it is effective that the reduction sensitization be carried out in the step of forming silver halide grains. The amount of each sensitizer used is generally determined depending on what type of silver halide grains are sensitized and what condition is adopted for the chemical sensitization. Specifically, the amount of a chalcogen sensitizer used is generally from $10^{-8}$ to $10^{-2}$ mole, preferably from $10^{31\ 7}$ to $5\times10^{-3}$ mole, per mole of silver halide. The amount of a noble metal sensitizer used is preferably from $10^{-7}$ to $10^{-2}$ mole per mole of silver halide. As to the conditions for chemical sensitization, there are no particular restrictions. However, it is preferable for chemical sensitization that the pAg be from 6 to 11, preferably from 7 to 10, the pH be from 4 to 10, and the temperature be from 40 to 95° C., preferably 45 to 85° C.

The silver halide photographic materials of the present invention have no particular restrictions as to their layer structures. When they are silver halide color photographic materials, however, they have a multi-layer structure for recording blue light, green light and red light separately. Further, each silver halide emulsion layer may be constituted of two layers, namely a high-speed layer and a low-speed layer. Examples of a practical layer structure are given below:

(1) BH/BL/GH/GL/RH/RL/S (2) BH/BM/BL/GH/GM/GL/RH/RM/RL/S (3) BH/BL/GH/RH/GL/RL/S (4) BH/GH/RH/BL/GL/RL/S (5) BH/BL/CL/GH/GL/RH/RL/S (6) BH/BL/GH/GL/CL/RH/RL/S

Therein, B stands for a blue-sensitive layer, G for a green-sensitive layer, R for a red-sensitive layer, H for a highest speed layer, M for a medium speed layer, L for a low speed layer, S for a support, and CL for an interlayer effect-providing layer. Light-insensitive layers, such as a protective layer, a filter layer, an interlayer, an anti-halation layer and a subbing layer, are omitted from the foregoing representation of layer structures. In addition, the arranging order of high speed and low speed layers having the same color sensitivity may be reversed. The layer structure (3) is described in U.S. Pat. No. 4,184,876. The layer structure (4) is described in *Research Disclosure*, vol. 225, No. 22534, and Japanese Patent Application (Laid-Open) Nos. 177551/1984 and 177552/1984. The layer structures (5) and (6) are described in Japanese Patent Application (Laid-Open) No. 34541/1986. The layer structures (1), (2) and (4) are preferred over the others. Besides color photographic materials, the silver halide light-sensitive materials of the present invention can be applied to X-ray photographic materials, sensitive materials for black and white photography, light-sensitive materials for photomechanical process and photographic printing paper.

For various additives usable in the silver halide emulsions of the present invention (e.g., binders, chemical sensitizers, spectral sensitizers, stabilizers, gelatin, hardeners, surfactants, antistatic agents, polymer latexes, matting agents, color couplers, ultraviolet absorbents, discoloration inhibitors, dyes), supports and processing methods for photographic materials (e.g., coating methods, exposure methods, development-processing methods), the descriptions in *Research Disclosure*, vol. 176, No. 17643 (abbreviated as "RD-17643"), vol. 187, No. 18716 (abbreviated as "RD-18716") and vol. 225, No. 22534 (abbreviated as "RD-22534") can be referred to. The locations where the additives are described in each of those references are listed below.

| Kinds of Additives | RD-17643 | RD-18716 | RD-22534 |
|---|---|---|---|
| 1. Chemical sensitizer | p. 23 | p. 648, right column | p. 24 |
| 2. Sensitivity increasing agent | | p. 648, right column | |
| 3. Spectral sensitizer and Supersensitizer | pp. 23–24 | p. 648, right column, to p. 649, right column | pp. 24–28 |
| 4. Brightening agent | p. 24 | | |
| 5. Antifoggant and Stabilizer | pp. 24–25 | p. 649, right column | p. 24 and p. 31 |
| 6. Light absorbent, Filter dye, UV absorbent | pp. 25–26 | p. 649, right column, to p. 650, left column | |
| 7. Stain inhibitor | p. 25, right column | p. 650, left to right column | |
| 8. Dye image stabilizer | p. 25 | | p. 32 |
| 9. Hardener | p. 26 | p. 651, left column | p. 32 |
| 10. Binder | p. 26 | p. 651, left column | p. 28 |
| 11. Plasticizer, Lubricant | p. 27 | p. 650, right column | |
| 12. Coating aid, Surfactant | pp. 26–27 | p. 650, right column | |
| 13. Antistatic agent | p. 27 | p. 650, right column | |
| 14. Color coupler | p. 25 | p. 649 | p. 31 |

With respect to gelatin hardeners, for example, active halogen compounds (such as 2,4-dichloro-6-hydroxy-1,3,5-triazine and sodium salt thereof) and active vinyl compounds (such as 1,3-bisvinylsulfonyl-2-propanol, 1,2-bis(vinyl-sulfonylacetamido)ethane and vinyl polymers having vinylsulfonyl groups in their chains) are used to advantage because they can quickly harden hydrophilic colloids such as gelatin to provide stable photographic characteristics. In addition, N-carbamoylpyridinium salts (such as (1-morpholinocarbonyl-3-pyridinio)methanesulfonate) and haloamidinium salts (such as 1-(1-chloro-1-pyridinomethylene)pyrrolidinium 2-naphthalenesulfonate) are also excellent hardeners because of their high hardening speed.

The silver halide color photographic materials can be processed using the general methods described in *Research Disclosure*, vol. 176, No. 17643 and ibid., vol. 187, No. 18716. Specifically, the color photographic materials are subjected sequentially to development processing, bleach-fix or fixation processing, and washing or stabilization processing. In the washing step, a counter-current washing method using two or more tanks is generally adopted to effect a water saving. As a typical example of stabilization processing which can take the place of washing processing, the multistage counter-current stabilization processing as disclosed in Japanese Patent Application (Laid-Open) No. 8543/1982 can be exemplified.

In addition to the above, for color couplers usable in the present invention the descriptions in paragraphs 0019 to 0024 of Japanese Patent Application (Laid-Open) No. 65007/1999 can be referred to. For chemical sensitization the descriptions in paragraphs 0041 to 0053 of the same publication can be referred to. For antifoggants the descriptions in paragraph 0057 of the same publication can be referred to. For sensitizing dyes the descriptions in paragraphs 0058 to 0060 of the same publication can be referred to. For development processing the descriptions in paragraphs 0080 to 0099 of the same publication can be referred to. For application to APS systems the descriptions in paragraphs 0100 to 0126 of the same publication can be referred to.

The present invention can be applied advantageously to color diffusion transfer photosensitive materials using internal latent image type direct-positive silver halide emulsions. The internal latent image type direct-positive silver halide: emulsions fogged with light and those chemically fogged with a nucleation agent. Of these types, chemically fogged type is preferred.

Examples of a nucleation agent suitable for chemical fogging include hydrazines, hydrazides, heterocyclic quaternary salt compounds, acylhydrazine compounds of thiourea-linking type, and hydrazine compounds to which heterocyclic groups, such as a thioamide ring residue, a triazolyl group and a tetrazolyl group, are attached as adsorptive groups.

Suitable examples of an internal latent image type direct-positive silver halide emulsion include the emulsions disclosed in U.S. Pat. Nos. 3,206,313, 3,761,266, 4,035,185, 4,395,478, 4,504,570, 4,434,226, 4,414,310 and 4,439,520.

In applying the gold-containing compound of formula (1) of the present invention to the internal latent image type direct-positive silver halide emulsion, it is preferable to use the compound of the present invention in an amount of $5\times10^{-5}$ to $1\times10^{-7}$ mole, preferably $1\times10^{-5}$ to $1\times10^{-6}$ mole, per more of silver halide constituting core grains. And it is favorable that the compound represented by L in formula (1), gold sensitizers and other chemical sensitizers, which may be used in combination with the compound of formula (1), are each used in a proportion of 100/1 to 1/100 (by mole), preferably 10/1 to 1/10 (by mole), to the compound of formula (1). In the case of chemically sensitizing the shell grains, it is also preferable to use those chemical sensitizers in the above-specified proportions to the silver halide constituting shell grains.

Color diffusion transfer photosensitive materials to which the present invention can be advantageously applied are described below.

Dye image-forming substances used in the present invention are non-diffusible compounds capable of releasing diffusible dyes (or dye precursors thereof) or substances capable of changing their own diffusibilities in conjunction with silver development, and such compounds are described in *The Theory of the Photographic Process*, 4th ed. All of these compounds can be represented by the following formula (3):

$$(\text{DYE—Y'})_p\text{—Z'} \qquad (3)$$

wherein DYE represents a dye moiety, a short wave-shifted dye moiety or a dye precursor, Y' represents a single bond or a linking group, Z' represents a group having a property of making a difference in dispersibility of the compound represented by $(\text{DYE—Y'})_p$—' or releasing DYE and making a dispersibility difference between the DYE released and $(\text{DYE—Y'})_p$—' in conjunction with silver development (specifically in imagewise response or counter-response to light-sensitive silver salt having a latent image), and p is 1 or 2. When p is 2 therein, two DYE—Y' moieties may be the same or different.

By the function of Z' in formula (3), the compounds of formula (3) are broadly divided into two varieties: negative compounds which become diffusible in silver developed areas and positive compounds which become diffusible in undeveloped areas.

Examples of negative Z', include groups which are oxidized as a result of development, undergo cleavage and release diffusible dyes.

These groups are described in U.S. Pat. Nos. 3,928,312, 4,055,428, 4,179,291, 4,149,892, 4,183,753, 4,142,891, 4,199,355 and 4,135,929, and Japanese Patent Application (Laid-Open) Nos. 50736/1978, 4043/1982, 130927/1979, 164342/1981 and 119345/1982.

As to Z' of negative dye-releasing redox compounds, N-substituted sulfamoyl groups (wherein the substituents on N atoms are groups derived from aromatic hydrocarbon rings or hetero rings) are preferable.

Examples of such compounds include compounds which are diffusible under an original alkaline condition but become non-diffusible when oxidized by development (namely dye developers). Representatives of Z' effective for those compounds are those described in U.S. Pat. No. 2,983,606.

Examples of compounds of another type include compounds which release diffusible dyes by self-closure of rings under an alkaline condition but cause substantially no release of dyes when they are oxidized as development proceeds. Examples of Z' which can ensure such a function are described in Japanese Patent Application (Laid-Open) Nos. 69033/1978 and 130927/1979, and U.S. Pat. Nos. 3,421,964 and 4,199,355.

As compounds of still another type, there are compounds which themselves do not release dyes but release dyes when reduced. The compounds of this type are used in combination with electron donors, and can released if fusible dyes by reaction with the remainder of the electron donors oxidized imagewise by silver development. The atomic groups having such a function are described, e.g., in U.S. Pat. Nos. 4,183,753 4,278,750, 4,218,368 and 4,358,535, Japanese Patent Application (Laid-Open) Nos. 110827/1978, 130927/1979 and 164342/1981, Journal of Technical Disclosure 87-6199, and EP-A2-220746.

For the compounds of this type, it is preferable to be used in combination with non-diffusible electron-donating compounds (known as ED compounds) or precursors thereof. Examples of ED compounds are described, e.g., in U.S. Pat. Nos. 4,263,393 and 4,278,750, and Japanese Patent Application (Laid-Open) No. 138736/1981.

Examples of dye image-forming substances of another type are described in U.S. Pat. Nos. 3,719,489 and 4,098,783.

On the other hand, examples of a dye represented by DYE in formula (3) are described in the following references.

Examples of Yellow Dyes:

They are described in U.S. Pat. Nos. 4,148,641, 4,148,643 and 4,336,322, Japanese Patent Application (Laid-Open) Nos. 114930/1976 and 71072/1981, and Research Disclosure, No. 17630 (1978) and No. 16475 (1977).

Examples of Magenta Dyes:

They are described in U.S. Pat. Nos. 3,932,380, 4,233,237, 4,250,246, 4,207,104 and 4,287,292, and Japanese Patent Application (Laid-Open) Nos. 36804/1980, 73057/1981 and 134/1980.

Examples of Cyan Dyes:

They are described in U.S. Pat. Nos. 3,482,972, 4,171,220, 4,142,891 and 4,148,642, U.K. Patent No. 1,551,138, Japanese Patent Application (Laid-Open) Nos. 8827/1977, 47823/1978 and 71061/1981, European Patent Nos. 53,037 and 53,040, and *Research Disclosure*, No. 17630 (1978) and No. 16475 (1977).

EXAMPLE

The present invention will now be illustrated in greater detail by reference to the following examples, but it should be understood that these examples are not to be construed as limiting the scope of the present invention in any way.

Example I-1

Preparation of Em-1

1,200 ml of an aqueous solution containing 1.0 g of KBr and 1.0 g of low molecular gelatin having a molecular weight of 15,000 was stirred vigorously as it was kept at 35° C. To this solution, 30 ml of an aqueous solution containing 1.9 g of $AgNO_3$ and 30 ml of an aqueous solution containing 1.5 g of KBr and 0.7 g of low molecular gelatin having a molecular weight of 15, 000 were added over a 30-second period in accordance with a double jet method, thereby effecting nucleation. During the addition, the excessive concentration of KBr was kept constant. Then, the reaction solution was admixed with 50 g of KBr and heated up to 75° C. for ripening. After the conclusion of ripening was added 35 g of phthalated gelatin having a phthalation rate of 97%, having a molecular weight of 100,000 and containing 35 $\mu$mol/g of methionine. The resulting solution was adjusted to pH 5.6. Thereto, 150 ml of an aqueous solution containing 30 g of $AgNO_3$ and an aqueous solution of KBr were added over a 16-minute period in accordance with a double jet method (growth process 1). During this process, the silver potential was kept at −20 mV with respect to a saturated calomel electrode. Further, an aqueous solution containing 110 g of $AgNO_3$ and an aqueous KBr solution (15 weight %) containing 3.8 mole % of KI were added over a 15-minute period in accordance with a double jet method (growth process 2). Therein, the flow rate was increased so that the final flow rate became 1.2 times the initial flow rate. During this addition process, the silver potential was kept at −20 mV. Then, the number of revolutions for stirring was restored to normal one, and 132 ml of an aqueous solution containing 35 g of $AgNO_3$ and an aqueous KBr solution were further added over a 7-minute period in accordance with a double jet method. Therein, the addition of the KBr solution was controlled so that the potential at the conclusion of the addition reached +20 mV. After adding 2 mg of sodium benzenethiosulfonate, the silver potential was adjusted to −20 mV by addition of KBr. Furthermore, 100 ml of an aqueous solution containing 6.8 g of $AgNO_3$ and 900 ml of an aqueous solution containing 7.1 g of KI were added over a 10-minute period in accordance with a double jet method. Just after the addition, 250 ml of an aqueous solution containing 70 g of $AgNO_3$ and 170 ml of an aqueous solution containing 50 g of KBr were added over a 20-minute period. After washing operation, 45 g of gelatin was added, and the resulting emulsion was adjusted to pH 5.8 and pAg 8.7 at 40° C. The thus prepared emulsion was designated as "Em-1".

From observation of Em-1 under a transmission electron microscope at the liquid-nitrogen temperature, it was found that dislocation lines were present at high densities in fringe parts of emulsion grains, and more specifically, each grain had at least 20 dislocation lines. Further, it was found that 61% of the emulsion grains in Em-1 were grains having aspect ratios of at least 8, the average aspect ratio of the emulsion grains was 9.0, the variation coefficient of iodide distribution among the emulsion grains was 17, and the average iodide content in the emulsion grains was 4.3 mole %.

[Chemical Sensitization and Spectral Sensitization]

Preparation of Fine Solid Dispersions of Sensitizing Dyes

Fine solid dispersions of Sensitizing Dyes 1 to 3 were prepared as follows:

In accordance with the preparation conditions set forth in Table I-1, the inorganic salts were dissolved in ion-exchanged water, thereto was added each sensitizing dye, and a dispersion operation was performed using dissolver blades at 2,000 rpm for 20 minutes under a temperature of 60° C., thereby preparing a fine solid dispersion of each of Sensitizing Dyes 1 to 3.

Sensitizing Dye 1

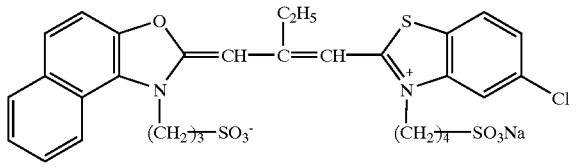

Sensitizing Dye 2

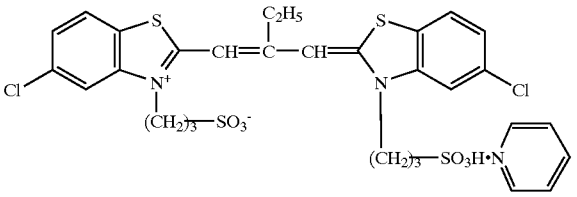

Sensitizing Dye 3

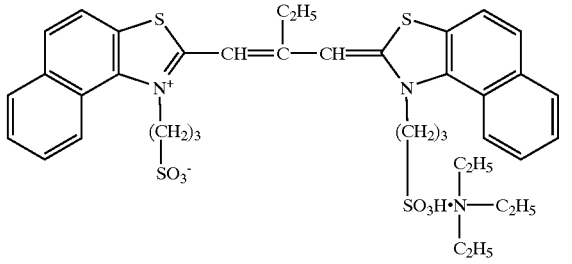

TABLE I-1

| Sensitizing Dye No. | Amount added | Amounts of inorganic salts added ($NaNO_3/Na_2SO_4$) | Amount of Water added | Dispersion time | Dispersion temperature |
|---|---|---|---|---|---|
| 1 | 3 pts. wt. | 0.8 pts. wt. /3.2 pts. wt. | 43 pts. wt. | 20 min | 60° C. |
| 2 | 4 pts. wt. | 0.6 pts. wt. /2.4 pts. wt. | 42.8 pts. wt. | 20 min | 60° C. |
| 3 | 0.12 pts. wt. | 0.6 pts. wt. /2.4 pts. wt. | 42.8 pts. wt. | 20 min | 60° C. |

Preparation of Emulsions Em-1AR to Em-7AR

The emulsion Em-1 was heated up to 56° C. Thereto, the fine solid dispersions prepared in the foregoing manners were added in amounts that the ratio between Sensitizing Dyes 1, 2 and 3 became 58:36:1 by mole. Then, 1,800 ppm of calcium nitrate was added to the resulting emulsion. Thereto were further added one of the gold-containing compounds of the present invention set forth in Table I-2, potassium thiocyanate ($1.5\times10^{-3}$ mol/mol Ag), chloroauric acid, N,N-dimethylthiourea and N,N-dimethylselenourea. The resulting emulsion was ripened and subjected to optimal chemical sensitization. At the conclusion of chemical sensitization, disodium salt of 1-(p-carboxyphenyl)-5-mercaptotetrazole was added. In this manner, emulsions Em-1AR to EM-7AR were each prepared.

TABLE I-2

| Sample No. | Chloro-auric acid (mol/mol Ag) | Gold complex or Gold-containing compound (mol Au/mol Ag) | N,N-di-methyl-thiourea (mol/mol Ag) | N,N-di-methyl-seleno-urea (mol/mol Ag) | fog | Relative sensi-Tivity | Δfog | note |
|---|---|---|---|---|---|---|---|---|
| Em-1AR | ($3\times10^{-6}$) | — | ($6\times10^{-6}$) | — | 0.38 | 100 | 0.52 | comparison |
| Em-2AR | — | HK-1 ($3\times10^{-6}$) | ($6\times10^{-6}$) | ($3\times10^{-6}$) | 0.36 | 103 | 0.55 | comparison |
| Em-3AR | — | 1-1 ($3\times10^{-6}$) | ($6\times10^{-6}$) | — | 0.27 | 113 | 0.31 | invention |
| Em-4AR | — | 1-4 ($3\times10^{-6}$) | — | ($3\times10^{-6}$) | 0.31 | 109 | 0.33 | invention |
| Em-5AR | — | 1-6 ($3\times10^{-6}$) | — | ($3\times10^{-6}$) | 0.30 | 110 | 0.35 | invention |
| Em-6AR | — | 1-10 ($3\times10^{-6}$) | — | ($3\times10^{-6}$) | 0.32 | 117 | 0.37 | invention |
| Em-7AR | — | 1-1 ($3\times10^{-6}$) | ($6\times10^{-6}$) | ($3\times10^{-6}$) | 0.29 | 117 | 0.32 | invention |

Comparative Compound HK-1

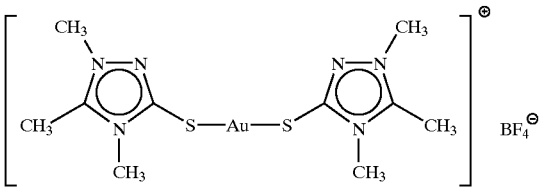

On a cellulose triacetate film support provided with a subbing layer, each of the chemically sensitized emulsions was coated simultaneously with formation of a protective layer under the coating conditions as described in Table I-3, thereby preparing samples.

TABLE I-3

| Ingredient | Coverage |
|---|---|
| (1) Emulsion Layer | |
| Each Emulsion | $2.1\times10^{-2}$ mol/m$^2$ (based on silver) |
| Coupler | $1.5\times10^{-3}$ mol/m$^2$ |

TABLE I-3-continued

| Ingredient | Coverage |
|---|---|
| 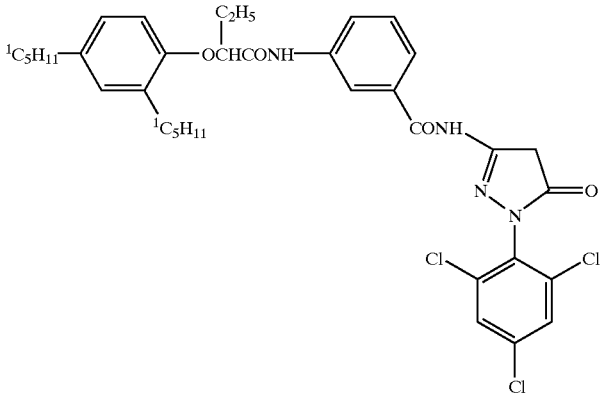 | 1.1 × $10^{-4}$ mol/$m^2$ |
| • 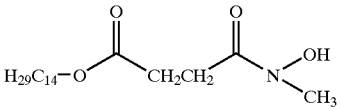 | |
| Tricrezyl phosphate | 1.10 g/$m^2$ |
| Gelatin | 2.30 g/$m^2$ |
| (2) Protective Layer | |
| Sodium 2,4-dichloro-6-hydroxy-s-triazine | 0.08 g/$m^2$ |
| Gelatin | 1.80 g/$m^2$ |

The thus prepared samples were allowed to stand for 14 hours under a condition of 70% relative humidity. Thereafter, each sample was exposed to light for 1/100 sec via a gelatin filter SC-50 and a continuous wedge made by Fuji Photo Film Co., Ltd.

Further, processing of each exposed sample with a Nega Processor FP-350 made by Fuji Photo Film Co., Ltd. was continued according to the method described below (till the cumulative volume of replenisher reached 3 times the tank volume of a mother liquor (i.e., a tank solution)).

Processing Method

| Processing Step | Processing time | Processing temperature | Replenisher volume** |
|---|---|---|---|
| Color development | 2 min 15 sec | 38° C. | 45 ml |
| Bleach*1) | 1 min 00 sec | 38° C. | 20 ml |
| Bleach-fix | 3 min 15 sec | 38° C. | 30 ml |
| Washing (1)*2) | 40 sec | 35° C. | |
| Washing (2) | 1 min 00 sec | 35° C. | 30 ml |
| Stabilization | 40 sec | 38° C. | 20 ml |
| Drying | 1 min 15 sec | 55° C. | |

*1)All the overflow of a bleaching solution was admitted into a bleach-fix tank
*2)Counter-current piping from the washing step (2) to the washing step (1)
**per 1.1 m length of a 35 mm-width film (corresponding to a 24-exposure roll)

Next the compositions of processing solutions used are described.

Color developer

| | Tank solution | Replenisher |
|---|---|---|
| Diethylenetriaminetetraacetic acid | 1.0 g | 1.1 g |
| 1-Hydroxyethylidene-1,1-di-phosphonic acid | 2.0 g | 2.0 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.4 g | 2.8 g |
| 4-[N-Ethyl-N-(β-hydroxyethyl)amino]-2-methylaniline sulfate | 4.5 g | 5.5 g |
| Water to make | 1.0 l | 1.0 l |
| pH (adjusted by use of KOH and $H_2SO_4$) | 10.05 | 10.10 |

Bleaching Solution used for Tank Solution and Replenisher in common

| | |
|---|---|
| Ammonium ethylenediaminetetraacetato-ferrate(III) dihydrate | 20.0 g |
| Disodium ethylenediaminetetraacetate | 10.0 g |
| Ammonium bromide | 100.0 g |
| Ammonium nitrate | 10.0 g |
| Bleach accelerator $(CH_3)_2N—CH_2—CH_2—S—S—CH_2—CH_2—N(CH_3)_2.2HCL$ | 0.005 mol |
| Aqueous ammonia (27%) | 15.0 ml |
| Water to make | 1.0 l |
| pH (adjusted by use of aqueous ammonia and $HNO_3$) | 6.3 |

Bleach-Fix Solution

| | Tank Solution | Replenisher |
|---|---|---|
| Ammonium ethylenediaminetetra-acetatoferrate(III) dihydrate | 50.0 g | — |

-continued

| | | |
|---|---|---|
| Disodium ethylenediaminetetraacetate | 0.5 g | 2.0 g |
| Sodium sulfite | 12.0 g | 20.0 g |
| Aqueous ammonium thiosulfate solution (700 g/l) | 240.0 ml | 400.0 ml |
| Aqueous ammonia (27%) | 6.0 ml | — |
| Water to make | 1.0 l | 1.0 l |
| pH (adjusted by use of aqueous ammonia and acetic acid) | 7.2 | 7.3 |

Washing Solution Used for Tank Solution and Replenisher in Common

City water was passed through a mixed-bed system column packed with a strongly acidic H-type cation exchange resin (Amberlite IR-120B produced by Rohm & Haas Co.) and an OH-type anion exchange resin (Amberlite IR-400 produced by Rohm & Haas Co.), and thereby the calcium and magnesium ion concentrations therein were each reduced to 3 mg/l or below. Then, the ion exchanged water was admixed with 20 mg/l of sodium dichloroisocyanurate and 0.15 g/l of sodium sulfate. The pH of the resultant water was within the range of 6.5–7.5.

| (Stabilizing Solution used for Tank Solution and Replenisher in common) | |
|---|---|
| Sodium p-toluenesulfinate | 0.03 g |
| Polyoxyethylene-p-monononylphenyl ether (average polymerization degree: 10) | 0.2 g |
| Disodium ethylenediaminetetraacetate | 0.05 g |
| 1,2,4-Triazole | 1.3 g |
| 1,4-Bis(1,2,4-triazole-1-ylmethyl)piperazine | 0.75 g |
| Water to make | 1.0 l |
| pH adjusted to | 8.5 |

Density measurements of the thus processed samples were made via a green filter. The sensitivity of each sample was defined as a relative value of the reciprocal of the exposure amount required for providing a density of the fog density plus 0.2.

Further, each sample underwent the following experiment for evaluation of keeping quality:

One piece of an unexposed sample was allowed to stand for 2 weeks at 50° C. and 60% relative humidity. The other piece was allowed to stand for 2 weeks at 5° C. Thereafter, these sample pieces were both subjected to 1/100-second sensitometric exposure at a color temperature of 4,800° K via a continuous wedge, and further to the same color photographic processing as described above, followed by the density measurements. And the difference between fog values of the sample pieces stored at 50° C. and 5° C. respectively (Δfog) was determined. The greater plus value means the higher density.

These results are also shown in Table I-2.

Additionally, the samples were prepared so that they were identical in gold atom content, and subjected to the density measurements. (Also, the samples were prepared so that they were identical in reactive sulfur group content or/and reactive selenium group content.)

As can be seen from Table I-2, there was a tendency that the sensitivities attained by addition of the gold-containing compounds of the present invention were higher than the sensitivity obtained by addition of chloroauric acid, and besides, the fog densities were low in the cases of adding the gold-containing compounds of the present invention, as compared with the case of adding chloroauric acid. Much to our surprise, it was found that fog increase upon storage was controlled considerably by use of the compounds of the present invention.

By contrast to the present invention, fog increase upon storage was not controlled by use of the compound HK-1 disclosed in Japanese Patent Application (Laid-Open) No. 267249/1992.

In these circumstances, it is said that the use of the gold-containing compounds of the present invention enables further improvements of photographic characteristics in comparison with the addition of conventional chloroauric acid or the gold complex compound.

Example I-2

On a cellulose triacetate film support provided with a subbing layer, layers of the following compositions were coated one on top of another to prepare Sample No. 101 as a multilayer color light-sensitive material.

Compositions of Light-sensitive Layers

Ingredients used in each layer are classified under the following groups;

| | | | |
|---|---|---|---|
| ExC: | cyan coupler | UV: | UV absorbent |
| ExM: | magenta coupler | HBS: | high boiling point solvent |
| ExY: | yellow coupler | H: | gelatin hardener |
| ExS: | sensitizing dye | ExF: | dye |

The figure corresponding to each ingredient is a coverage expressed in the unit g/m$^2$, and the coverage concerning silver halide is indicated on a silver basis. With respect to sensitizing dyes, on the other hand, the coverage of each sensitizing dye is expressed in mole per mole of silver halide contained in the same layer.

| (Sample No. 101) | | |
|---|---|---|
| First layer (First anti-halation layer) | | |
| Black colloidal silver | silver | 0.155 |
| Silver iodobromide Emulsion P | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |
| Second layer (Second anti-halation layer) | | |
| Black colloidal silver | silver | 0.066 |
| Gelatin | | 0.407 |
| ExM-1 | | 0.050 |
| ExF-1 | | $2.0 \times 10^{-3}$ |
| HBS-1 | | 0.074 |
| Solid disperse dye ExF-2 | | 0.015 |
| Solid disperse dye ExF-3 | | 0.020 |
| Third layer (Interlayer) | | |
| Silver iodobromide Emulsion O | silver | 0.020 |
| ExC-2 | | 0.022 |
| Polyethyl acrylate latex | | 0.085 |
| Gelatin | | 0.294 |

-continued (Sample No. 101)

Fourth layer (Low-speed red-sensitive emulsion layer)

| | | |
|---|---|---|
| Silver iodobromide Emulsion A | silver | 0.323 |
| ExS-1 | | $5.5 \times 10^{-4}$ |
| ExS-2 | | $1.0 \times 10^{-5}$ |
| ExS-3 | | $2.4 \times 10^{-4}$ |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |

Fifth layer (Medium-speed red-sensitive emulsion layer)

| | | |
|---|---|---|
| Silver iodobromide Emulsion B | silver | 0.28 |
| Silver iodobromide Emulsion C | silver | 0.54 |
| ExS-1 | | $5.0 \times 10^{-4}$ |
| ExS-2 | | $1.0 \times 10^{-5}$ |
| ExS-3 | | $2.0 \times 10^{-4}$ |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |

Sixth layer (High-speed red-sensitive emulsion layer)

| | | |
|---|---|---|
| Silver iodobromide Emulsion D | silver | 1.47 |
| ExS-1 | | $3.7 \times 10^{-4}$ |
| ExS-2 | | $1 \times 10^{-5}$ |
| ExS-3 | | $1.8 \times 10^{-4}$ |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |

Seventh layer (Interlayer)

| | | |
|---|---|---|
| Cpd-1 | | 0.089 |
| Solid disperse dye ExF-4 | | 0.030 |
| HBS-1 | | 0.050 |
| Polyethyl acrylate latex | | 0.83 |
| Gelatin | | 0.84 |

Eighth layer (Layer giving interlayer effect to red-sensitive layers)

| | | |
|---|---|---|
| Silver iodobromide Emulsion E | silver | 0.560 |
| ExS-6 | | $1.7 \times 10^{-4}$ |
| ExS-10 | | $4.6 \times 10^{-4}$ |
| Cpd-4 | | 0.030 |
| ExM-2 | | 0.096 |
| ExM-3 | | 0.028 |
| ExY-1 | | 0.031 |
| HBS-1 | | 0.085 |
| HBS-3 | | 0.003 |
| Gelatin | | 0.58 |

Ninth layer (Low-speed green-sensitive emulsion layer)

| | | |
|---|---|---|
| Silver iodobromide Emulsion F | silver | 0.39 |
| Silver iodobromide Emulsion G | silver | 0.28 |
| Silver iodobromide Emulsion H | silver | 0.35 |
| ExS-4 | | $2.4 \times 10^{-5}$ |
| ExS-5 | | $1.0 \times 10^{-4}$ |
| ExS-6 | | $3.9 \times 10^{-4}$ |
| ExS-7 | | $7.7 \times 10^{-5}$ |
| ExS-8 | | $3.3 \times 10^{-4}$ |

-continued (Sample No. 101)

| | | |
|---|---|---|
| ExM-2 | | 0.36 |
| ExM-3 | | 0.045 |
| HBS-1 | | 0.28 |
| HBS-3 | | 0.01 |
| HBS-4 | | 0.27 |
| Gelatin | | 1.39 |

Tenth layer (Medium-speed green-sensitive emulsion layer)

| | | |
|---|---|---|
| Silver iodobromide Emulsion I | silver | 0.45 |
| ExS-4 | | $5.3 \times 10^{-5}$ |
| ExS-7 | | $1.5 \times 10^{-4}$ |
| ExS-8 | | $6.3 \times 10^{-4}$ |
| ExC-6 | | 0.009 |
| ExM-2 | | 0.031 |
| ExM-3 | | 0.029 |
| ExY-1 | | 0.006 |
| ExM-4 | | 0.028 |
| HBS-1 | | 0.064 |
| HBS-3 | | $2.1 \times 10^{-3}$ |
| Gelatin | | 0.44 |

Eleventh layer (High-speed green-sensitive emulsion layer)

| | | |
|---|---|---|
| Silver iodobromide Emulsion I | silver | 0.19 |
| Silver iodobromide Emulsion J | silver | 0.80 |
| ExS-4 | | $4.1 \times 10^{-5}$ |
| ExS-7 | | $1.1 \times 10^{-4}$ |
| ExS-8 | | $4.9 \times 10^{-4}$ |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| Cpd-3 | | 0.004 |
| Cpd-4 | | 0.007 |
| HBS-1 | | 0.18 |
| Polyethyl acrylate latex | | 0.099 |
| Gelatin | | 1.11 |

Twelfth layer (Yellow filter layer)

| | | |
|---|---|---|
| Yellow colloidal silver | silver | 0.047 |
| Cpd-1 | | 0.16 |
| Solid disperse dye ExF-5 | | 0.020 |
| Solid disperse dye ExF-6 | | 0.020 |
| Water-soluble dye ExF-7 | | 0.010 |
| HBS-1 | | 0.082 |
| Gelatin | | 1.057 |

Thirteenth layer (Low-speed blue-sensitive emulsion layer)

| | | |
|---|---|---|
| Silver iodobromide Emulsion K | silver | 0.18 |
| Silver iodobromide Emulsion L | silver | 0.20 |
| Silver iodobromide Emulsion M | silver | 0.07 |
| ExS-9 | | $4.4 \times 10^{-4}$ |
| ExS-10 | | $4.0 \times 10^{-4}$ |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |

Fourteenth layer (High-speed blue-sensitive emulsion layer)

| | | |
|---|---|---|
| Silver iodobromide Emulsion N | silver | 0.75 |
| ExS-9 | | $3.6 \times 10^{-3}$ |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $10 \times 10^{-3}$ |
| HBS-1 | | 0.10 |
| Gelatin | | 0.91 |

-continued

| (Sample No. 101) | |
|---|---|
| Fifteenth layer (First protective layer) | |
| Silver iodobromide Emulsion O | silver 0.30 |
| UV-1 | 0.21 |
| UV-2 | 0.13 |
| UV-3 | 0.20 |
| UV-4 | 0.025 |
| F-18 | 0.009 |
| HBS-1 | 0.12 |
| HBS-4 | $5.0 \times 10^{-2}$ |
| Gelatin | 2.3 |
| Sixteenth layer (Second protective layer) | |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.75 |

In order to improve keeping quality, processability, pressure resistance, anti-mold and anti-bacterial properties, antistatic properties and coatability, each layer further contained W-1 to W-5, B-4 to B-6, F-1 to F-18, and iron, lead, gold, platinum, palladium, iridium, ruthenium and rhodium salts in their respectively preferable amounts. To the coating composition for the eighth layer and that for the eleventh layer, an aqueous solution of calcium nitrate was furthermore added in amounts of $8.5\times10^{-3}$ g and $7.9\times10^{-3}$ g, respectively, based on calcium per mole of silver halide.

AgI contents, grain sizes, surface iodide contents and other characteristics of the emulsions denoted by capitals are shown in Table I-4. The surface iodide content can be examined by XPS in the following manner:

Each sample was cooled down to −115° C. under reduced pressure of 1×10 Torr, and irradiated with MgKα as probe X-ray at the X-ray source voltage of 8 kV and the X-ray current of 20 mA. And energies of Ag3d5/2, Br3d, I3d5/2 electrons emitted were measured. The integral strengths of the peaks measured were corrected with their individual sensitivity factors. The surface iodide content was determined from the ratio between these corrected integral strengths.

TABLE I-4

| Emulsion Name | Average iodide content (mol %) | Variation coefficient with respect to iodide distribution among grains | Average grain size (equivalent sphere diameter: μm) | variation coefficient of equivalent sphere diameter (%) | Projected area diameter (equivalent circle diameter: μm) | Diameter/ thick-ness ratio | Surface iodide content (mol %) | Grain shape |
|---|---|---|---|---|---|---|---|---|
| Emulsion A | 3.9 | 20 | 0.37 | 19 | 0.40 | 2.7 | 2.3 | tabular |
| Emulsion B | 5.1 | 17 | 0.52 | 21 | 0.67 | 5.2 | 3.5 | tabular |
| Emulsion C | 7.0 | 18 | 0.86 | 22 | 1.27 | 5.9 | 5.2 | tabular |
| Emulsion D | 4.2 | 17 | 1.00 | 18 | 1.53 | 6.5 | 2.8 | tabular |
| Emulsion E | 7.2 | 22 | 0.87 | 22 | 1.27 | 5.7 | 5.3 | tabular |
| Emulsion F | 2.6 | 18 | 0.28 | 19 | 0.28 | 1.3 | 1.7 | tabular |
| Emulsion G | 4.0 | 17 | 0.43 | 19 | 0.58 | 3.3 | 2.3 | tabular |
| Emulsion H | 5.3 | 18 | 0.52 | 17 | 0.79 | 6.5 | 4.7 | tabular |
| Emulsion I | 5.5 | 16 | 0.73 | 15 | 1.03 | 5.5 | 3.1 | tabular |
| Emulsion J | 7.2 | 19 | 0.93 | 18 | 1.45 | 5.5 | 5.4 | tabular |
| Emulsion K | 1.7 | 18 | 0.40 | 16 | 0.52 | 6.0 | 2.1 | tabular |
| Emulsion L | 8.7 | 22 | 0.64 | 18 | 0.86 | 6.3 | 5.8 | tabular |
| Emulsion M | 7.0 | 20 | 0.51 | 19 | 0.82 | 5.0 | 4.9 | tabular |
| Emulsion N | 6.5 | 22 | 1.07 | 24 | 1.52 | 7.3 | 3.2 | tabular |
| Emulsion O | 1.0 | — | 0.07 | — | 0.07 | 1.0 | — | uniform structure |
| Emulsion P | 0.9 | — | 0.07 | — | 0.07 | 1.0 | — | uniform structure |

The following additional remarks are made about the emulsions shown in Table 1–4:

(1) Emulsions L to O subjected to reduction sensitization with thiourea dioxide and thiosulfonic acid at time of grain preparation in accordance with Examples of Japanese Patent Application (Laid-Open) No. 191938/1990, (2) Emulsions A to O subjected to gold sensitization, sulfur sensitization and selenium sensitization in the presence of the sensitizing dyes incorporated in the sensitive layers corresponding thereto respectively and sodium thiocyanate in accordance with Examples of Japanese Patent Application (Laid-Open) No. 237450/1991, and (3) in preparing tabular grains, low molecular weight gelatin was used according to Examples of Japanese Patent Application (Laid-Open) No. 158426/1989, and besides, (4) on the tabular grains, dislocation lines as described in Japanese Patent Application (Laid-Open) No.237450/1991 were observed with a high-voltage electron microscope.

Preparation of Dispersion of Organic Solid Disperse Dye

A solid disperse dye ExF-2 illustrated hereinafter was dispersed in the following manner. Specifically, in a 700 ml of pot mill were placed 21.7 ml of water, 3 ml of a 5% aqueous solution of sodium p-octylphenoxyethoxyethoxyethanesulfonate and 0.5 g of p-octylphenoxypolyoxyethylene ether (polymerization degree: 10) as a 5% aqueous solution. Thereto, 5.0 g of the dye ExF-2 and 500 ml of zirconium oxide beads (diameter: 1 mm) were added. The contents were dispersed for 2 hours. For the dispersion, a BO-type vibration ball mill made by Chuo Koki Co. Ltd. was used. After the conclusion of dispersion, the contents were taken out of the mill, and thereto 8 g of a 12.5% aqueous gelatin solution was added. Further, the beads were removed by filtration. Thus, a gelatin dispersion of dye was obtained. The average particle size of the particulate dye was 0.44 μm.

Similarly to the above, solid dispersions of ExF-3, ExF-4 and ExF-6 were prepared individually. The average particle sizes of the particulate dyes in those solid dispersions were 0.24 μm, 0.45 μm and 0.52 μm, respectively. On the other hand, ExF-5 was dispersed in accordance with the micro-precipitation dispersion method described in Example 1 of EP-A-549489. The average particle size attained therein was 0.06 μm.

The ingredients used for forming the constituent layers are illustrated below:

ExC-1

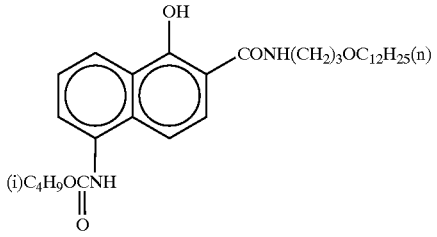

ExC-2

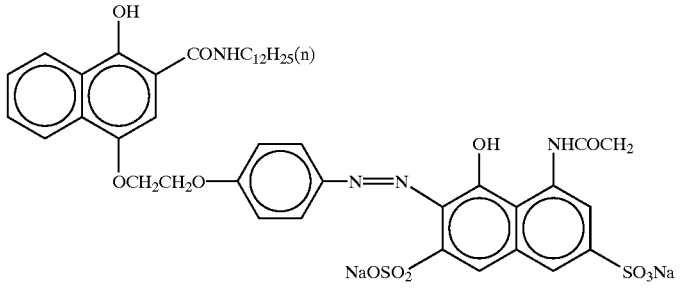

ExC-3

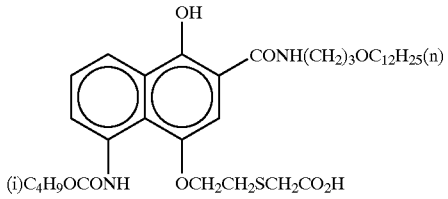

ExC-4

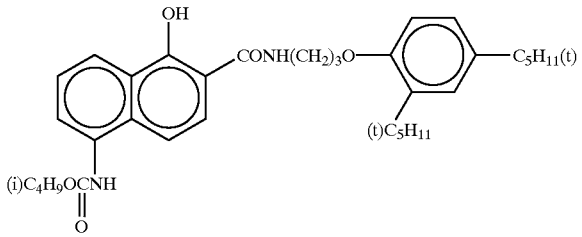

-continued
ExC-5
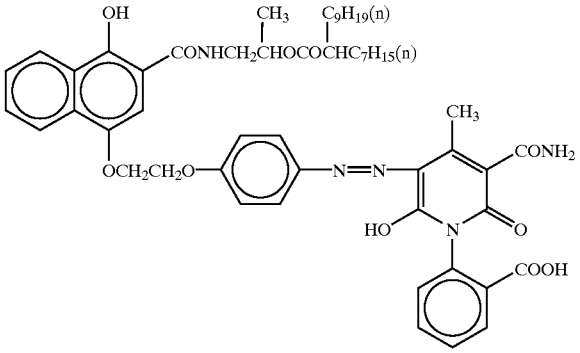
ExC-6
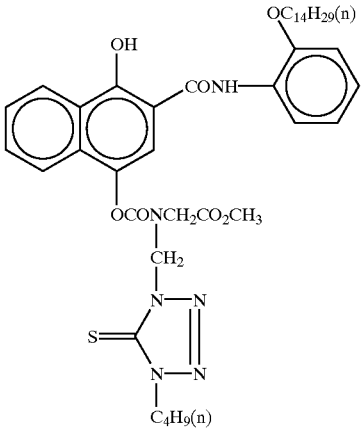
ExC-7
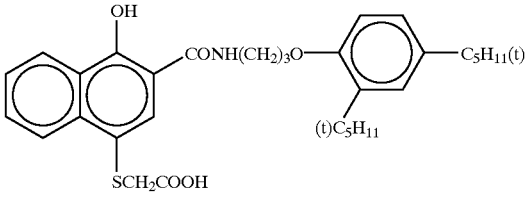
ExC-8
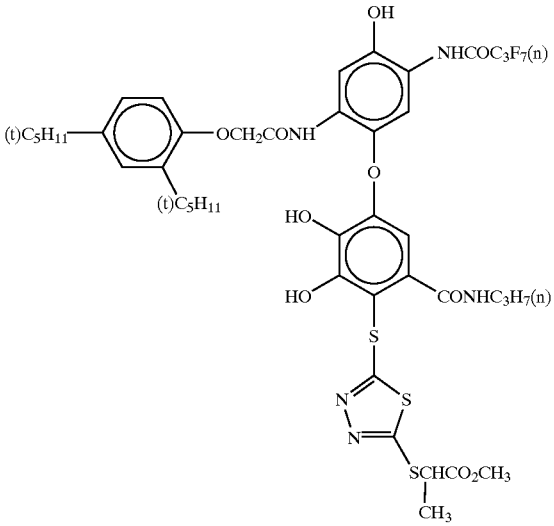

-continued
ExM-1
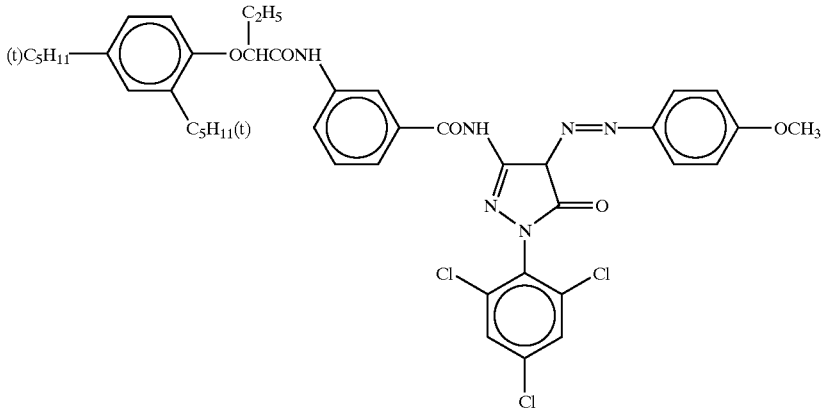
ExM-2
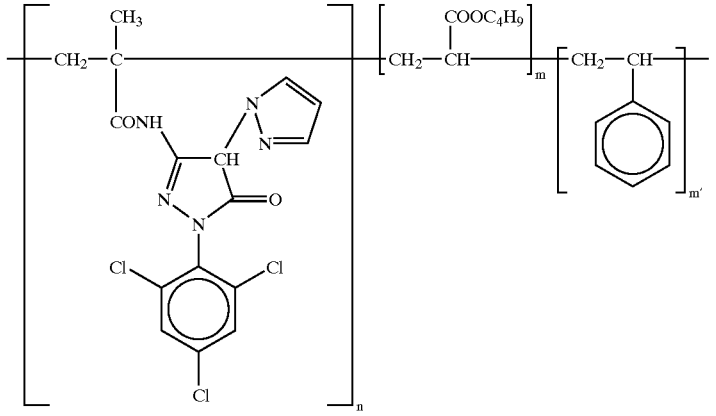
n = 50
m = 25
m′ = 25
mol. wt. about 20,000
ExM-3
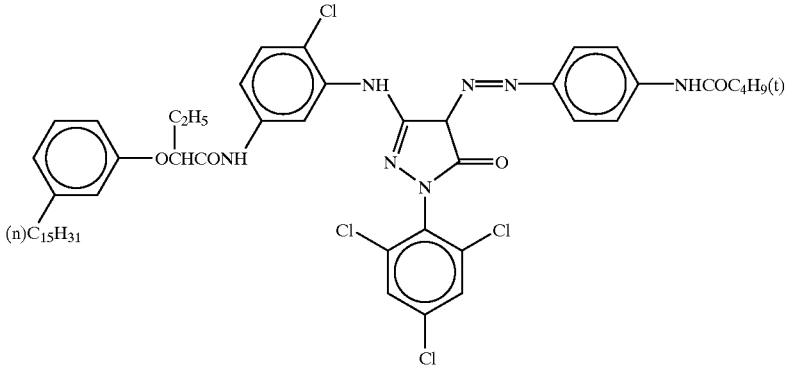

-continued
ExM-4
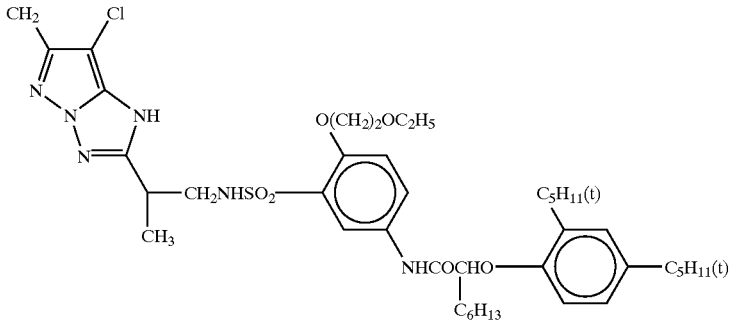
ExM-5
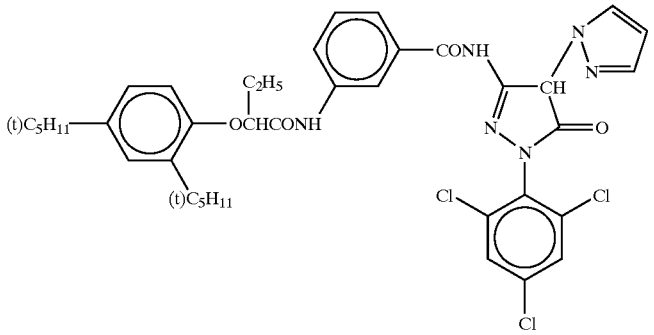
ExY-1
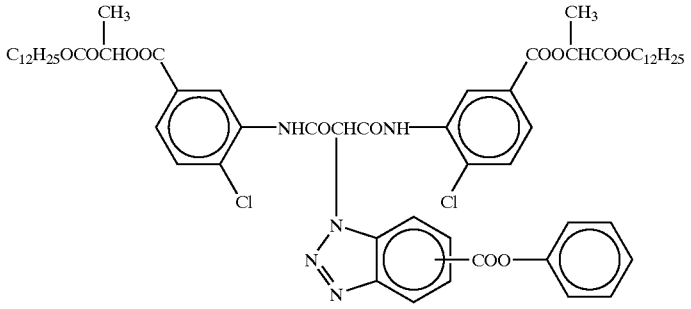
ExY-2
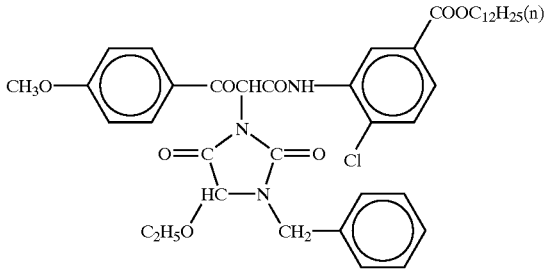
ExY-3
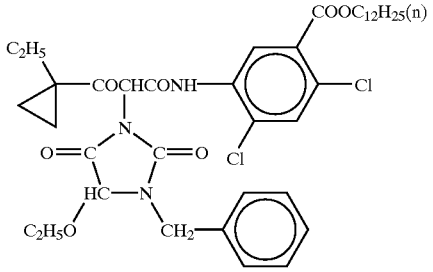

-continued
ExY-4
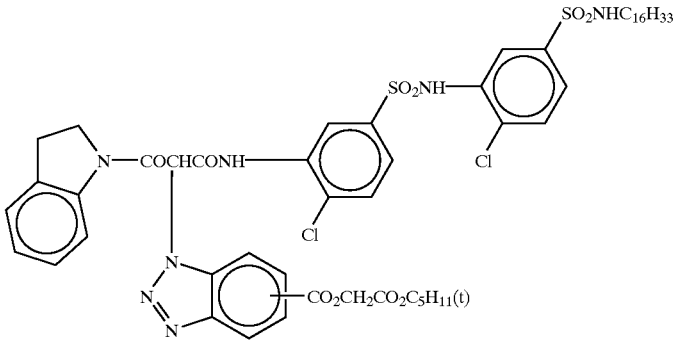
ExY-5
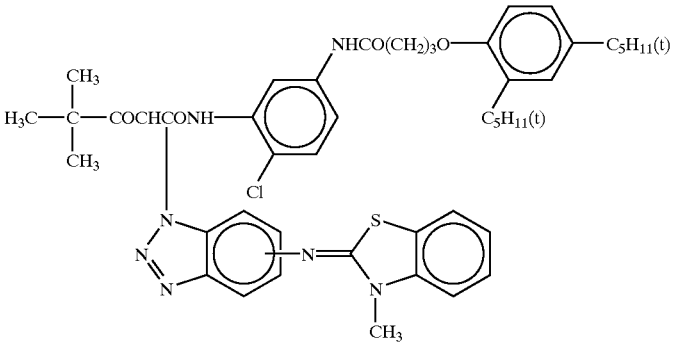
ExY-6
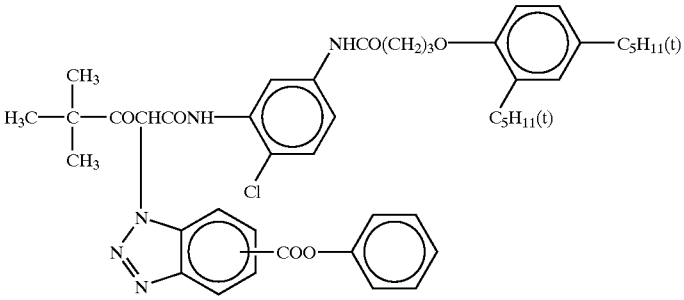
ExF-1
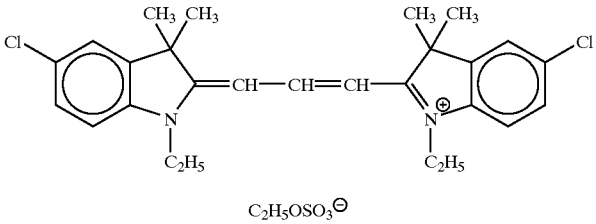
ExF-2
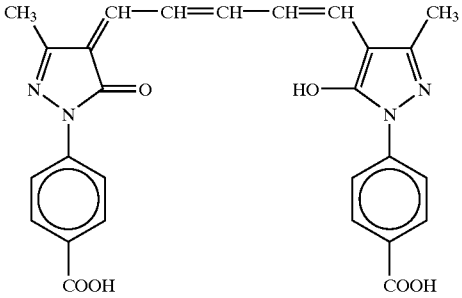

-continued
ExF-3
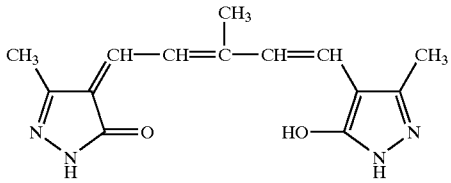
ExF-4
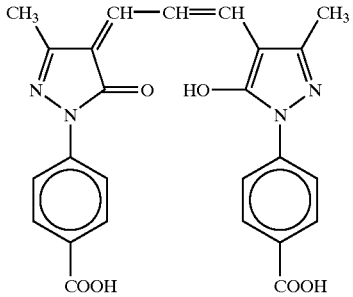
ExF-5
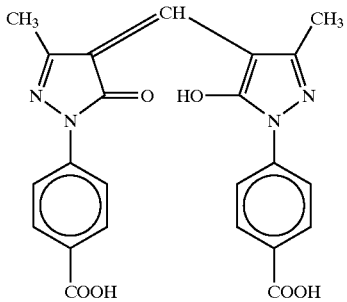
ExF-6
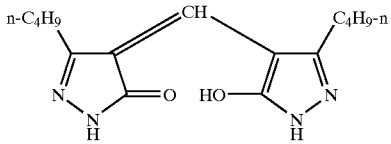
ExF-7
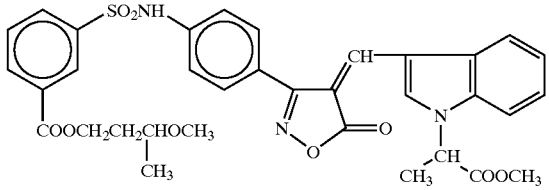
Cpd-1
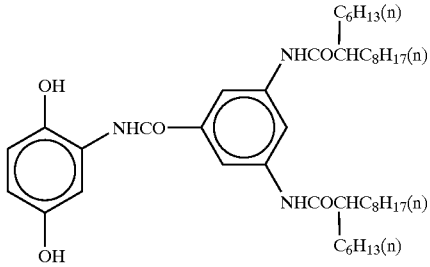
Cpd-2
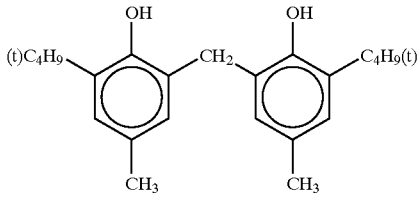

-continued
Cpd-3
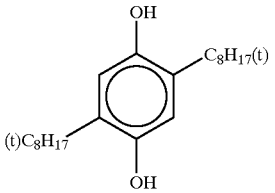
Cpd-4
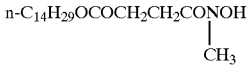
UV-1
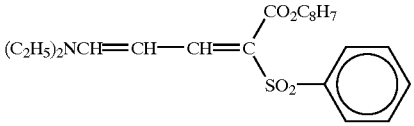
UV-2
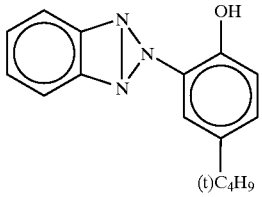
UV-3
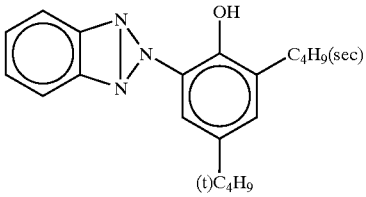
UV-4
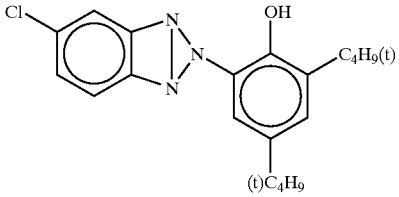
ExS-3
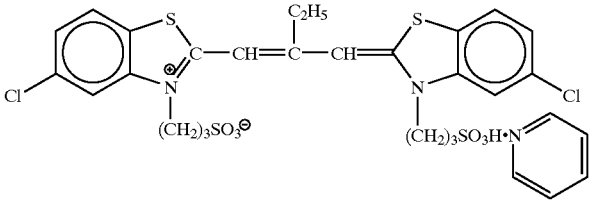
ExS-4
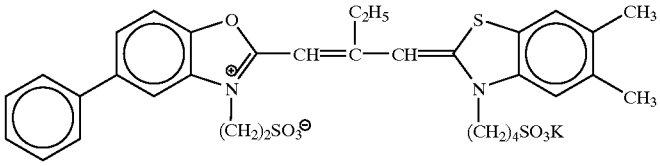
ExS-5
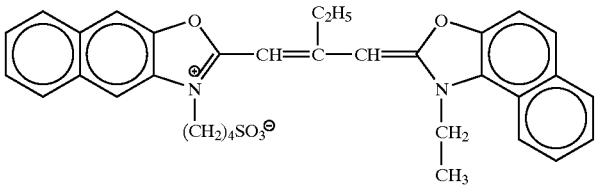
ExS-6
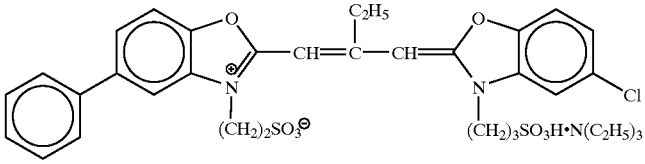
Tricresyl phosphate
HBS-1
Di-n-butyl phthalate
HBS-2
HBS-3
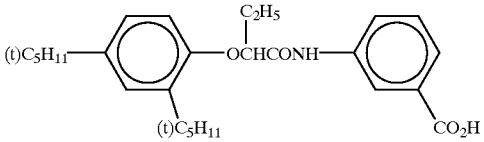
Tri(2-ethylhexyl) phosphate
HBS-4

-continued
ExS-1
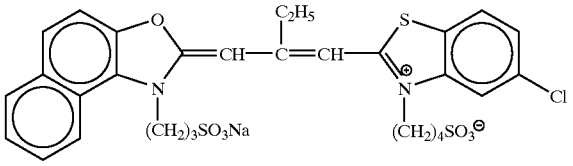
ExS-2
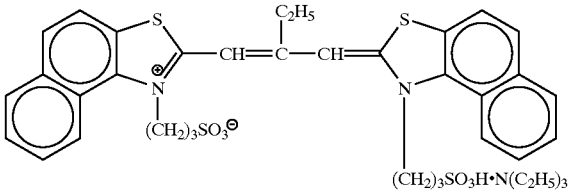
ExS-7
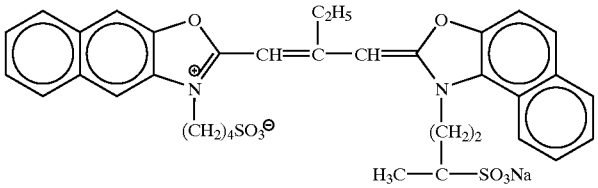
ExS-8
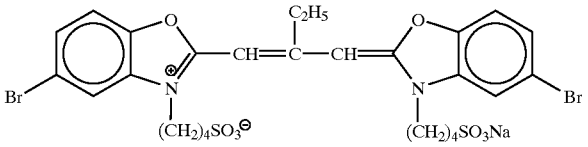
ExS-9
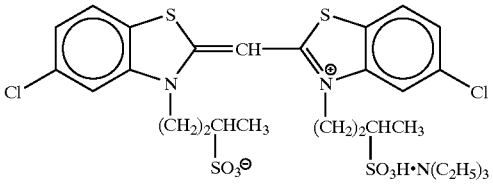
ExS-10
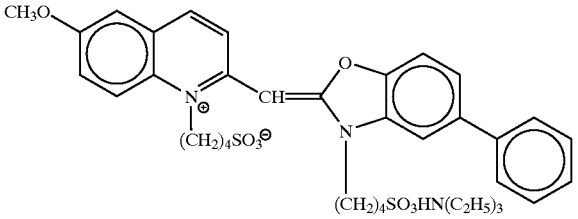
S-1
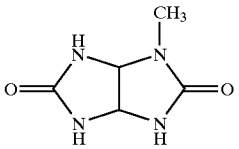
H-1
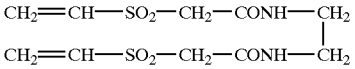
B-1
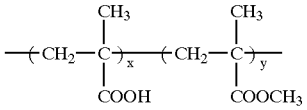
x/y = 10/90 (by weight)
average molecular weight: about 35,000
B-2
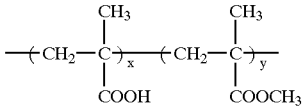
x/y = 40/60 (by weight)
average molecular weight: about 20,000

-continued
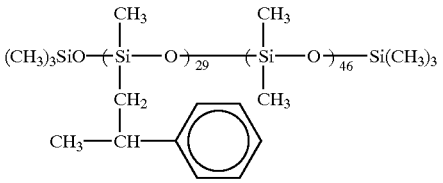
(by mole)
average molecular weight: about 8,000
B-3
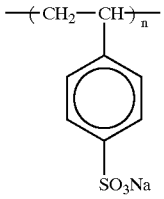
average molecular weight: about 750,000
B-4
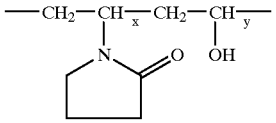
x/y = 70/30 (by weight)
average molecular weight: about 17,000
B-5
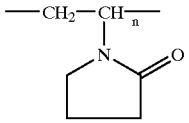
average molecular weight: about 10,000
B-6
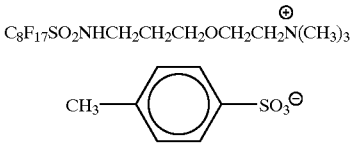
W-1
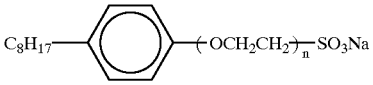
n = 2~4
W-2
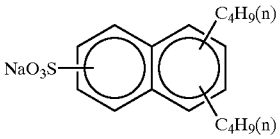
W-3
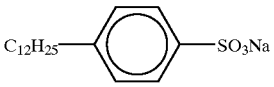
W-4
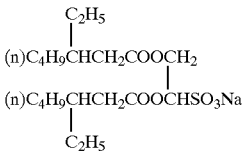
W-5
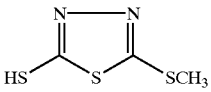
F-1
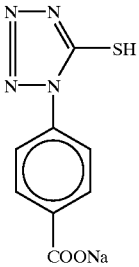
F-2
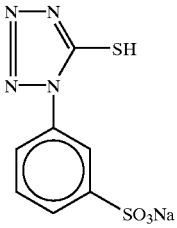
F-3
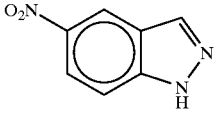
F-4
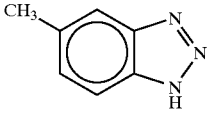
F-5
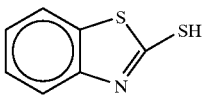
F-6
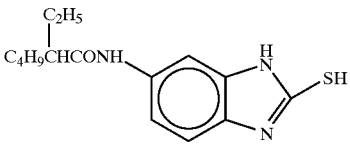
F-7

-continued

F-8

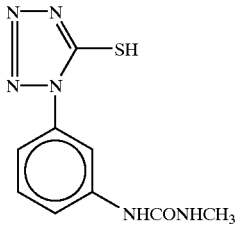

F-9

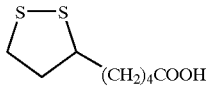

F-10

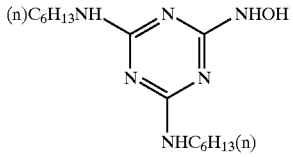

F-11

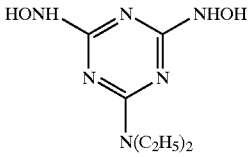

F-12

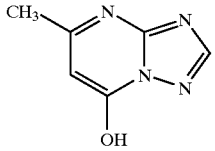

F-13

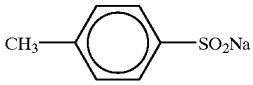

F-14

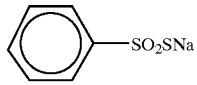

F-15

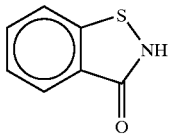

F-16

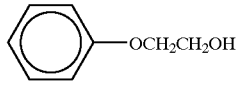

F-17

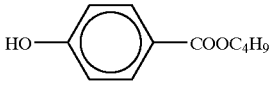

F-18

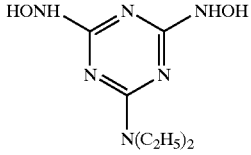

Preparation of Sample Nos. 102 to 104

Sample Nos. 102 to 104 were prepared in the same manner as Sample No. 101, except that the silver iodobromide Emulsion D incorporated in the sixth layer was replaced by Em-1AR, Em-2AR and Em-4AR prepared in Example I-1, respectively.

The samples thus prepared were each exposed under the same condition as in Example I-1, and then subjected to the following photographic processing.

(Photographic Processing Method)

| Processing Step | Processing Time | Processing Temperature |
|---|---|---|
| Color development | 3 min 15 sec | 38° C. |
| Bleach | 3 min 00 sec | 38° C. |
| Washing | 30 sec | 24° C. |
| Fixation | 3 min 00 sec | 38° C. |
| Washing (1) | 30 sec | 24° C. |
| Washing (2) | 30 sec | 24° C. |
| Stabilization | 30 sec | 38° C. |
| Drying | 4 min 20 sec | 55° C. |

The compositions of processing solutions used in those steps are described below:

(Color Developer)

| | |
|---|---|
| Diethylenetriaminetetraacetic acid | 1.0 g |
| 1-Hydroxyethylidene-1,1-di-phosphonic acid | 2.0 g |
| Sodium sulfite | 4.0 g |
| Potassium carbonate | 30.0 g |
| Potassium bromide | 1.4 g |
| Potassium iodide | 1.5 mg |
| Hydroxylamine sulfate | 2.4 g |
| 4-[N-Ethyl-N-(β-hydroxyethyl)amino]-2-methylaniline sulfate | 4.5 g |
| Water to make | 1.0 l |
| pH (adjusted by use of KOH and $H_2SO_4$) | 10.05 |

(Bleach Solution)

| | |
|---|---|
| Sodium ethylenediaminetetraacetato-ferrate(III) trihydrate | 100.0 g |
| Disodium ethylenediaminetetraacetate | 10.0 g |
| 3-Mercapto-1,2,4-triazole | 0.03 g |
| Ammonium bromide | 140.0 g |
| Ammonium nitrate | 30.0 g |
| Aqueous ammonia (27%) | 6.5 ml |
| Water to make | 1.0 l |
| pH (adjusted by use of aqueous ammonia and $HNO_3$) | 6.0 |

-continued

| (Fixing Solution) | |
|---|---|
| Disodium ethylenediaminetetraacetate | 0.5 g |
| Ammonium sulfite | 20.0 g |
| Aqueous ammonium thiosulfate solution (700 g/l) | 295.0 ml |
| Acetic acid (90%) | 3.3 ml |
| Water to make | 1.0 l |
| pH (adjusted by use of ammonia water and acetic acid) | 6.7 |
| **(Stabilizing Solution)** | |
| p-Nonylphenoxypolyglycidol (glycidol average polymerization degree: 10) | 0.2 g |
| Ethylenediaminetetraacetic acid | 0.05 g |
| 1,2,4-Triazole | 1.3 g |
| 1,4-Bis(1,2,4-triazole-1-ylmethyl)piperazine | 0.75 g |
| Hydroxyacetic acid | 0.02 g |
| Hydroxyethyl cellulose (HEC SP-2000, produced by Daicel Chemical Industries Ltd.) | 0.1 g |
| 1,2-Benzisothiazoline-3-one | 0.05 g |
| Water to make | 1.0 l |
| pH adjusted to | 8.5 |

Density measurements via a red filter were made on each of the thus processed samples, and thereby fog values, sensitivities and fog increases upon storage were evaluated using the same methods as in Example I-1. The evaluation results are shown in Table I-5.

By these examinations, it was confirmed that the Emulsion Em-4AR of the present invention alone enabled the multi-layer color photographic material to achieve high sensitivity and low fog and to reduce a fog increase upon storage.

333782/1995, except that the emulsion Em-D7 incorporated in the 8th, 15th and 22nd layers of the Sample 102 was replaced by the emulsion Em-7AR prepared in the Example I-1 of the present invention. A cover sheet also was prepared in the same manner as in the example of the reference, and the same processing as in the example of the reference was carried out. The photographic properties obtained (maximum density and gradation) were all satisfactory.

Further, it was found that the gold-containing compound represented by formula (1) of the present invention had a tendency to increase the sensitivity and to decrease the fog, compared with the combination of chloroauric acid with the ligand of the gold complex, and enabled control of a fog increase upon long-term storage.

Example II-1

Preparation of Em-1

Em-1 as an emulsion was prepared in the same manner as in Example I-1.

(Chemical Sensitization and Spectral Sensitization)

Preparation of Fine Solid Dispersions of Sensitizing Dyes

Fine solid dispersions of Sensitizing Dyes 1 to 3 were prepared in the same manners as in Example I-1, respectively.

TABLE I-5

| Sample No. | Chloro-auric acid (mol/mol Ag) | Gold complex or Gold-containing compound (mol Au/mol Ag) | N,N-di-methyl-thiourea (mol/mol Ag) | N,N-di-methyl-selenourea (mol/mol Ag) | Relative sensi-tivity | Δfog | note |
|---|---|---|---|---|---|---|---|
| 102 | $(3 \times 10^{-6})$ | — | $(6 \times 10^{-6})$ | — | 100 | 0.19 | comparison |
| 103 | — | HK-1 $(3 \times 10^{-6})$ | $(6 \times 10^{-6})$ | $(3 \times 10^{-6})$ | 101 | 0.22 | comparison |
| 104 | | 1-4 $(3 \times 10^{-6})$ | — | $(3 \times 10^{-6})$ | 107 | 0.14 | invention |

Example I-3

Samples were prepared in the same manners as in Example I-2, except that the cellulose triacetate film support was replaced by the same support as used for Sample 104 prepared in Example 1 of U.S. Pat. No. 5,597,682. Specifically, the support used was a PEN support provided with a subbing layer and a backing layer and further subjected to thermal treatment in accordance with the procedure described from column 21, line 54, to column 23, line 29, of the reference described above. These samples each was loaded in a shooting function-attached package unit, and evaluated by the same method as in Example I-2. The evaluation results obtained were the same as in Example I-2.

Example I-4

A color diffusion transfer photosensitive material was prepared in the same manner as Sample 102 prepared in Example 1 of Japanese Patent Application (Laid-Open) No.

Preparation of Em-1AR to Em-15AR

The emulsion Em-1 was heated up to 56° C., and admixed with the fine solid dispersions of sensitizing dyes in amounts that the ratio between Sensitizing Dyes 1, 2 and 3 became 58:36:1 by mole. Then, 1,800 ppm of calcium nitrate was added to the admixture. Thereto were further added one of the gold compounds of the present invention shown in Table II-2, a sulfur sensitizer, potassium thiocyanate ($1.5\times10^{-3}$ mol/mol Ag), chloroauric acid and N,N-dimethylselenourea. The resulting emulsion was ripened and subjected to optimal chemical sensitization. At the conclusion of chemical sensitization, disodium salt of 1-(p-carboxyphenyl)-5-mercaptotetrazole was added. In this manner, emulsions Em-1AR to EM-15AR were each prepared.

TABLE II-2

| Emulsion | Known gold sensitizer (mol/mol Ag) | Super fine grains of present gold compound (mol/mol Ag) | Sulfur sensitizer (mol/mol Ag) | N,N-dimethyl-selenourea (mol/mol Ag) | Fog | Relative sensi-tivity | Δfog | note |
|---|---|---|---|---|---|---|---|---|
| Em-1AR | Chloroauric acid ($3 \times 10^{-6}$) | — | $Na_2S_2O_3$ ($3 \times 10^{-6}$) | ($3 \times 10^{-6}$) | 0.39 | 100 | 0.53 | comparison |
| Em-2AR | HK-1 ($3 \times 10^{-6}$) | — | $Na_2S_2O_3$ ($3 \times 10^{-6}$) | ($3 \times 10^{-6}$) | 0.35 | 104 | 0.56 | comparison |
| Em-3AR | — | G-2 ($3 \times 10^{-6}$) | $Na_2S_2O_3$ ($3 \times 10^{-6}$) | ($3 \times 10^{-6}$) | 0.25 | 113 | 0.35 | invention |
| Em-4AR | — | G-3 ($3 \times 10^{-6}$) | $Na_2S_2O_3$ ($3 \times 10^{-6}$) | ($3 \times 10^{-6}$) | 0.29 | 109 | 0.38 | invention |
| Em-5AR | — | G-5 ($3 \times 10^{-6}$) | $Na_2S_2O_3$ ($3 \times 10^{-6}$) | ($3 \times 10^{-6}$) | 0.25 | 112 | 0.36 | invention |
| Em-6AR | — | G-8 ($3 \times 10^{-6}$) | $Na_2S_2O_3$ ($3 \times 10^{-6}$) | ($3 \times 10^{-6}$) | 0.26 | 113 | 0.35 | invention |
| Em-7AR | — | G-13 ($3 \times 10^{-6}$) | $Na_2S_2O_3$ ($3 \times 10^{-6}$) | ($3 \times 10^{-6}$) | 0.30 | 107 | 0.39 | invention |
| Em-8AR | — | G-16 ($3 \times 10^{-6}$) | $Na_2S_2O_3$ ($3 \times 10^{-6}$) | ($3 \times 10^{-6}$) | 0.31 | 106 | 0.39 | invention |
| Em-9AR | — | G-22 ($3 \times 10^{-6}$) | $Na_2S_2O_3$ ($3 \times 10^{-6}$) | ($3 \times 10^{-6}$) | 0.28 | 109 | 0.37 | invention |
| Em-10AR | — | G-25 ($3 \times 10^{-6}$) | $Na_2S_2O_3$ ($3 \times 10^{-6}$) | ($3 \times 10^{-6}$) | 0.26 | 111 | 0.35 | invention |
| Em-11AR | — | G-26 ($3 \times 10^{-6}$) | $Na_2S_2O_3$ ($3 \times 10^{-6}$) | ($3 \times 10^{-6}$) | 0.25 | 113 | 0.36 | invention |
| Em-12AR | — | G-27 ($3 \times 10^{-6}$) | $Na_2S_2O_3$ ($3 \times 10^{-6}$) | ($3 \times 10^{-6}$) | 0.27 | 112 | 0.35 | invention |
| Em-13AR | — | G-28 ($3 \times 10^{-6}$) | $Na_2S_2O_3$ ($3 \times 10^{-6}$) | ($3 \times 10^{-6}$) | 0.26 | 113 | 0.34 | invention |
| Em-14AR | — | G-34 ($3 \times 10^{-6}$) | $Na_2S_2O_3$ ($3 \times 10^{-6}$) | ($3 \times 10^{-6}$) | 0.32 | 105 | 0.40 | invention |
| Em-15AR | — | G-40 ($3 \times 10^{-6}$) | $Na_2S_2O_3$ ($3 \times 10^{-6}$) | ($3 \times 10^{-6}$) | 0.33 | 104 | 0.41 | invention |

Comparative Compound (HK-1)

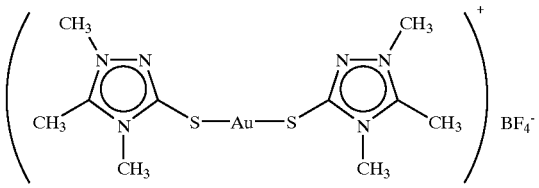

On a cellulose triacetate film support provided with a subbing layer, each of those chemically sensitized emulsions was coated simultaneously with formation of a protective layer under the coating conditions as described in Table I-3 of Example I-1, there by preparing samples. The samples thus obtained were each exposed and development-processed in the same manners as in Example I-1.

Density measurements of the thus processed samples were made via a green filter. The sensitivity of each sample was defined as a relative value of the reciprocal of the exposure amount required for providing a density of the fog density plus 0.2.

Further, each sample underwent the following experiment for evaluation of keeping quality:

One piece of an unexposed sample was allowed to stand for 2 weeks at 50° C. and 60% relative humidity. The other piece was allowed to stand for 2 weeks at 5° C. Thereafter, these sample pieces were both subjected to 1/100-second sensitometric exposure at a color temperature of 4,800° K via a continuous wedge, and further to the same color photographic processing as in Example I-1, followed by the density measurements. And the difference between fog values of the sample pieces stored at 50° C. and 5° C. respectively (Δfog) was determined. The greater plus value means the higher density.

These results are also shown in Table II-2.

As can be seen from Table II-2, there was a tendency that the high sensitivities and the low fog densities were attained in the cases of adding the gold compounds of the present invention in a state of super fine grain, compared with the case of adding chloroauric acid. Much to our surprise, it was found that fog increase upon storage was controlled considerably by use of the compounds of the present invention.

In the case of using the compound HK-1 disclosed in Japanese Patent Application (Laid-Open) No. 267249/1992, fog increase upon storage was not controlled in contrast to the present invention.

Example II-2

On a cellulose triacetate film support provided with a subbing layer, layers having the same compositions as in Example I-2 were coated one on top of another to prepare Sample No. 101 as a multi-layer color light-sensitive material.

AgI contents, grain sizes, surface iodide contents and other characteristics of the emulsions used for the preparation of Sample No. 101 are shown in Table II-4. The surface iodide content can be examined by XPS in the following manner:

Each sample was cooled down to −115° C. under reduced pressure of 1×10 Torr, and irradiated with MgKα as probe X-ray at the X-ray source voltage of 8 kV and the X-ray current of 20 mA. And energies of Ag3d5/2, Br3d, I3d5/2 electrons emitted were measured. The integral strengths of the peaks measured were corrected with their individual sensitivity factors. The surface iodide content was determined from the ratio between these corrected integral strengths.

TABLE II-4

| Emulsion Name | Average iodide content (mol %) | Variation coefficient with respect to iodide distribution among grains | Average grain size (equivalent sphere diameter: μm) | variation coefficient of equivalent sphere diameter (%) | Projected area diameter (equivalent circle diameter: μm) | Diameter/ thick-ness ratio | Surface iodide content (mol %) | Grain shape |
|---|---|---|---|---|---|---|---|---|
| Emulsion A | 3.9 | 20 | 0.37 | 19 | 0.40 | 2.7 | 2.3 | tabular |
| Emulsion B | 5.1 | 17 | 0.52 | 21 | 0.67 | 5.2 | 3.5 | tabular |
| Emulsion C | 7.0 | 18 | 0.86 | 22 | 1.27 | 5.9 | 5.2 | tabular |
| Emulsion D | 4.2 | 17 | 1.00 | 18 | 1.53 | 6.5 | 2.8 | tabular |
| Emulsion E | 7.2 | 22 | 0.87 | 22 | 1.27 | 5.7 | 5.3 | tabular |
| Emulsion F | 2.6 | 18 | 0.28 | 19 | 0.28 | 1.3 | 1.7 | tabular |
| Emulsion G | 4.0 | 17 | 0.43 | 19 | 0.58 | 3.3 | 2.3 | tabular |
| Emulsion H | 5.3 | 18 | 0.52 | 17 | 0.79 | 6.5 | 4.7 | tabular |
| Emulsion I | 5.5 | 16 | 0.73 | 15 | 1.03 | 5.5 | 3.1 | tabular |
| Emulsion J | 7.2 | 19 | 0.93 | 18 | 1.45 | 5.5 | 5.4 | tabular |
| Emulsion K | 1.7 | 18 | 0.40 | 16 | 0.52 | 6.0 | 2.1 | tabular |
| Emulsion L | 8.7 | 22 | 0.64 | 18 | 0.86 | 6.3 | 5.8 | tabular |
| Emulsion M | 7.0 | 20 | 0.51 | 19 | 0.82 | 5.0 | 4.9 | tabular |
| Emulsion N | 6.5 | 22 | 1.07 | 24 | 1.52 | 7.3 | 3.2 | tabular |
| Emulsion O | 1.0 | — | 0.07 | — | 0.07 | 1.0 | — | uniform structure |
| Emulsion P | 0.9 | — | 0.07 | — | 0.07 | 1.0 | — | uniform structure |

With respect to the emulsions shown in Table II-4:

(1) Emulsions L to O subjected to reduction sensitization with thiourea dioxide and thiosulfonic acid at time of grain preparation in accordance with Examples of Japanese Patent Application (Laid-Open) No. 191938/1990, (2) Emulsions A to O subjected to gold sensitization, sulfur sensitization and selenium sensitization in the presence of the spectral sensitizing dyes incorporated in the light-sensitive layers corresponding thereto respectively and sodium thiocyanate in accordance with Examples of Japanese Patent Application (Laid-Open) No. 237450/1991, and (3) in preparing tabular grains, low molecular weight gelatin was used according to Examples of Japanese Patent Application (Laid-Open) No. 158426/1989, and besides, (4) on the tabular grains, dislocation lines as described in Japanese Patent Application (Laid-Open) No.237450/1991 were observed with a high-voltage electron microscope.

Preparation of Dispersion of Organic Solid Disperse Dye

A solid disperse dye ExF-2 was dispersed in the following manner. Specifically, in a 700 ml of pot mill were placed 21.7 ml of water, 3 ml of a 5% aqueous solution of sodium p-octylphenoxyethoxyethoxyethanesulfonate and 0.5 g of p-octylphenoxypolyoxyethylene ether (polymerization degree: 10) as a 5% aqueous solution. Thereto, 5.0 g of the dye ExF-2 and 500 ml of zirconium oxide beads (diameter: 1 mm) were added. The contents were dispersed for 2 hours. For the dispersion, a BO-type vibration ball mill made by Chuo Koki Co. Ltd. was used. At the conclusion of dispersion, the contents were taken out of the mill, and thereto 8 g of a 12.5% aqueous gelatin solution was added. Further, the beads were removed by filtration. Thus, a gelatin dispersion of dye was obtained. The average particle size of the particulate dye was 0.44 μm.

Similarly to the above, solid dispersions of ExF-3, ExF-4 and ExF-6 were prepared individually. The average particle sizes of the particulate dyes in those solid dispersions were 0.24 μm, 0.45 μm and 0.52 μm, respectively. On the other hand, ExF-5 was dispersed in accordance with the micro-precipitation dispersion method described in Example 1 of EP-A-549489. The average particle size attained therein was 0.06 μm.

The ingredients used for forming the constituent layers were the same compounds as illustrated in Example I-2.

(Preparation of Samples Nos. 102 to 108)

Sample Nos. 102 to 108 were prepared in the same manner as Sample No. 101, except that the silver iodobromide Emulsion D in the sixth layer was replaced by the emulsions Em-1AR, Em-2AR, Em-3AR, Em-4AR, Em-8AR, Em-10AR and Em-14AR prepared in Example II-1, respectively.

The samples thus prepared were each exposed under the same condition as in Example I-1, and then underwent the same photographic processing as in Example I-2.

Density measurements via a red filter were made on each of the thus processed samples, and thereby fog values, sensitivities and fog increases upon storage were evaluated using the same methods as in Example II-1. The evaluation results are shown in Table II-5.

By these examinations, it was confirmed that the emulsions Em-3AR, Em-4AR, Em-8AR, Em-10AR and Em-14AR of the present invention each enabled the multi-layer color light-sensitive material to achieve high sensitivity and low fog and to reduce a fog increase upon storage.

TABLE II-5

| Sample No. | Known gold sensitizer (mol/mol Ag) | Super fine grains of gold compound (mol/mol Ag) | Sulfur sensitizer (mol/mol Ag) | Relative sensitivity | Δfog | note |
|---|---|---|---|---|---|---|
| 102 | Chloroauric acid ($3 \times 10^{-6}$) | — | $Na_2S_2O_3$ ($3 \times 10^{-6}$) | 100 | 0.17 | comparison |
| 103 | HK-1 ($3 \times 10^{-6}$) | — | $Na_2S_2O_3$ ($3 \times 10^{-6}$) | 101 | 0.18 | comparison |
| 104 | — | G-2 ($3 \times 10^{-6}$) | $Na_2S_2O_3$ ($3 \times 10^{-6}$) | 107 | 0.11 | invention |
| 105 | — | G-3 ($3 \times 10^{-6}$) | $Na_2S_2O_3$ ($3 \times 10^{-6}$) | 106 | 0.13 | invention |
| 106 | — | G-16 ($3 \times 10^{-6}$) | $Na_2S_2O_3$ ($3 \times 10^{-6}$) | 106 | 0.14 | invention |
| 107 | — | G-25 ($3 \times 10^{-6}$) | $Na_2S_2O_3$ ($3 \times 10^{-6}$) | 108 | 0.12 | invention |
| 108 | — | G-34 ($3 \times 10^{-6}$) | $Na_2S_2O_3$ ($3 \times 10^{-6}$) | 105 | 0.14 | invention |

Example II-3

Samples were prepared in the same manners as in Example II-2, except that the cellulose triacetate film support was replaced by the same support as used for Sample 104 prepared in Example 1 of U.S. Pat. No. 5,597,682. Specifically, the support used was a PEN support provided with a subbing layer and a backing layer and further subjected to thermal treatment in accordance with the procedure described from column 21, line 54, to column 23, line 29, of the reference described above. These samples each was loaded in a shooting function-attached package unit, and evaluated by the same method as in Example II-2. The evaluation results obtained were the same as in Example II-2.

Example II-4

A color diffusion transfer photosensitive material was prepared in the same manner as Sample 102 prepared in Example 1 of Japanese Patent Application (Laid-Open) No. 333782/1995, except that the emulsion Em-D7 incorporated in the 8th, 15th and 22nd layers of the Sample 102 was replaced by the emulsion Em-7AR prepared in the Example II-1 of the present invention. A cover sheet also was prepared in the same manner as in the example of the reference, and the same processing as in the example of the reference was carried out. The photographic properties obtained (maximum density and gradation) were all satisfactory.

Further, it was found that super fine grains of the gold compound represented by formula (2) of the present invention had a tendency to increase the sensitivity and to decrease the fog, compared with other gold sensitizers, and enabled control of a fog increase upon long-term storage.

In addition, the gold compounds of the present invention in a state of super fine grain, which are represented by compositional formula (2), enabled great increases in both midpoint and toe sensitivities of photographic light-sensitive materials using the internal latent image type direct-positive silver halide emulsions, as compared with other gold sensitizers.

The entitle disclosure of each and every foreign patent application from which the benefit of foreign priority has been claimed in the present application is incorporated herein by reference, as if fully set forth herein.

While the invention has been described in detail and with reference to specific embodiments thereof, it will be apparent to one skilled in the art that various changes and modifications can be made therein without departing from the spirit and scope thereof.

What is claimed is:

1. A silver halide emulsion, comprising at least one gold-containing compound represented by composition formula (1):

$$[Au(0)Lm]Xn \quad (1)$$

wherein Au(0) is an Au atom having a valence of zero, L is a compound having at least one group capable of being adsorbed to or coordinating with Au(0), m is a value of 0 or more including decimals, X is an ion required for neutralizing electric charge of the compound, and n is a value of 0 or more including decimals.

2. A silver halide emulsion, being chemically sensitized with a gold-containing compound represented by composition formula (1):

$$[Au(0)Lm]Xn \quad (1)$$

wherein Au(0) is an Au atom having a valence of zero, L is a compound having at least one group capable of being adsorbed to or coordinating with Au(0), m is a value of 0 or more including decimals, X is an ion required for neutralizing electric charge of the compound, and n is a value of 0 or more including decimals.

3. The silver halide emulsion as in claim 2, wherein the L in composition formula (1) is a compound having a group containing at least one atom selected from the group consisting of a sulfur atom, a selenium atom, a tellurium atom, a nitrogen atom and a phosphorus atom.

4. The silver halide emulsion as in claim 2, wherein the compound represented by L in composition formula (1) has at least one hydrophilic group.

5. The silver halide emulsion as in claim 4, wherein the hydrophilic group is a carboxyl group, a sulfo group or an ammonium salt.

6. The silver halide emulsion as in claim 2, wherein the group capable of being adsorbed to or coordinating with Au(0) is a mercapto group, an alkylthio group, an arylthio group or a thiocarbonyl group.

7. The silver halide emulsion as in claim 2, wherein the L in composition formula (1) is a compound having at least one mercapto group and at least one carboxyl group.

8. The silver halide emulsion as in claim 2, wherein the L in composition formula (1) is thiomalic acid.

9. The silver halide emulsion as in claim 2, wherein the L in composition formula (1) is at least one compound selected form the group consisting of a thioether compound, a selenoether compound, a telluroether compound, a thioamide compound, a selenoamide compound, a telluroamide compound, an amino group-containing compound, a phosphino group-containing compound and a nitrogen-containing heterocyclic compound.

10. The silver halide emulsion as in claim 2, wherein the compound of composition formula (1) is in a state of super fine grain having an average size of not greater than 10 nm.

11. The silver halide emulsion as in claim 2, comprising silver halide grains in which at least 60% of a projected area of all the silver halide grains are occupied by a tabular silver halide grain having an aspect ratio of at least 8.

12. The silver halide emulsion as in claim 2, wherein the silver halide emulsion is an internal latent image type direct-positive silver halide emulsion which comprises silver halide grains having a core/shell structure made up of a chemically sensitized core and a chemically sensitized shell.

13. A method of chemically sensitizing a silver halide emulsion, using a compound of composition formula (1):

$$[Au(0)Lm]Xn \quad (1)$$

wherein Au(0) is an Au atom having a valence of zero, L is a compound having at least one group capable of being adsorbed to or coordinating with Au(0), m is a value of 0 or more including decimals, X is an ion required for neutralizing electric charge of the compound, and n is a value of 0 or more including decimals.

14. The method of chemically sensitizing a silver halide emulsion as in claim 13, wherein the silver halide emulsion comprises internal latent image type direct-positive silver halide grains having a core/shell structure made up of a chemically sensitized core and a chemically sensitized shell, and at least one of the core and the shell is chemically sensitized in the presence of super fine grains of at least one gold-containing compound of composition formula (1).

15. A silver halide photographic material comprising a support having thereon at least one silver halide emulsion layer, wherein the silver halide emulsion layer comprises at least one silver halide emulsion containing at least one gold-containing compound represented by composition formula (1):

$$[Au(0)Lm]Xn \quad (1)$$

wherein Au(0) is an Au atom having a valence of zero, L is a compound having at least one group capable of being adsorbed to or coordinating with Au(0), m is a value of 0 or more including decimals, X is an ion required for neutralizing electric charge of the compound, and n is a value of 0 or more including decimals.

16. The silver halide emulsion as in claim 1, wherein the gold-containing compound represented by composition formula (1) is a compound represented by composition formula (2):

$$Au(0)L^1m \quad (2)$$

wherein $L^1$ represents a compound coordinating with Au(0) via a group other than a mercapto group, and m has the same meaning as in composition formula (1).

17. The silver halide emulsion as in claim 16, wherein the $L^1$ in composition formula (2) is a compound coordinating with Au(0) via one of sulfur, selenium and tellurium atoms.

18. The silver halide emulsion as in claim 16, wherein the $L^1$ in composition formula (2) is a compound coordinating with Au(0) via a nitrogen atom or a phosphorus atom.

* * * * *